US010096877B2

(12) United States Patent
Jensen et al.

(10) Patent No.: US 10,096,877 B2
(45) Date of Patent: Oct. 9, 2018

(54) PARTIAL DIELECTRIC LOADED SEPTUM POLARIZER

(71) Applicant: VIASAT, INC., Carlsbad, CA (US)

(72) Inventors: Anders Jensen, Johns Creek, GA (US); John D Voss, Cumming, GA (US); Donald L Runyon, Duluth, GA (US)

(73) Assignee: VIASAT, INC., Carlsbad, CA (US)

( * ) Notice: Subject to any disclaimer, the term of this patent is extended or adjusted under 35 U.S.C. 154(b) by 0 days.

(21) Appl. No.: 15/824,847

(22) Filed: Nov. 28, 2017

(65) Prior Publication Data

US 2018/0123203 A1 May 3, 2018

Related U.S. Application Data

(63) Continuation of application No. 15/482,130, filed on Apr. 7, 2017, now Pat. No. 9,859,597, which is a
(Continued)

(51) Int. Cl.
*H01P 5/12* (2006.01)
*H01P 1/17* (2006.01)
(Continued)

(52) U.S. Cl.
CPC ..... *H01P 1/172* (2013.01); *H01P 1/161* (2013.01); *H01P 1/173* (2013.01); *H01Q 1/1214* (2013.01);
(Continued)

(58) Field of Classification Search
CPC ..... H01P 1/172; H01Q 1/1214; H01Q 13/28
(Continued)

(56) References Cited

U.S. PATENT DOCUMENTS 2,895,134 A 1/1953 Sichak
3,681,769 A 8/1972 Perrotti et al.
(Continued)

FOREIGN PATENT DOCUMENTS

CN 203225337 U 10/2013
DE 4437595 A1 5/1996
(Continued)

OTHER PUBLICATIONS

Bozzi et al., "A Compact, Wideband, Phase-Equalized Waveguide Divider/Combiner for Power Amplification", 33rd European Microwave Conference, Oct. 2003, pp. 155-158.
(Continued)

*Primary Examiner* — Robert J Pascal
*Assistant Examiner* — Kimberly Glenn

(57) ABSTRACT

In an example embodiment, a waveguide device comprises: a first common waveguide; a polarizer section, the polarizer section including a conductive septum dividing the first common waveguide into a first divided waveguide portion and a second waveguide divided portion; a second waveguide coupled to the first divided waveguide portion of the polarizer section; a third waveguide coupled to the second divided waveguide portion of the polarizer section; and a dielectric insert. The dielectric insert includes a first dielectric portion partially filling the polarizer section. The conductive septum and the dielectric portion convert a signal between a polarized state in the first common waveguide and a first polarization component in the second waveguide and a second polarization component in the third waveguide.

14 Claims, 21 Drawing Sheets

Related U.S. Application Data continuation-in-part of application No. 14/723,272, filed on May 27, 2015, now Pat. No. 9,640,847.

(51) Int. Cl.

| | |
|---|---|
| ***H01Q 13/28*** | (2006.01) |
| ***H01Q 1/12*** | (2006.01) |
| ***H01P 1/161*** | (2006.01) |
| ***H01Q 13/06*** | (2006.01) |
| ***H01Q 21/06*** | (2006.01) |

(52) U.S. Cl.
CPC ..... *H01Q 13/06* (2013.01); *H01Q 13/28* (2013.01); *H01Q 21/064* (2013.01)

(58) Field of Classification Search
USPC ..... 333/125
See application file for complete search history.

(56) References Cited

U.S. PATENT DOCUMENTS

| | | | |
|---|---|---|---|
| 4,122,406 | A | 10/1978 | Salzberg |
| 4,126,835 | A | 11/1978 | Gould |
| 4,356,459 | A | 10/1982 | Gould et al. |
| 4,395,685 | A | 7/1983 | Davies et al. |
| 4,492,938 | A | 1/1985 | Young |
| 4,743,915 | A | 5/1988 | Rammos et al. |
| 4,783,663 | A | 11/1988 | Rammos et al. |
| 4,795,993 | A | 1/1989 | Park et al. |
| 5,061,037 | A | 10/1991 | Wong et al. |
| 5,086,304 | A | 2/1992 | Collins |
| 5,243,357 | A | 9/1993 | Koike et al. |
| 5,291,650 | A | 3/1994 | Carvalho et al. |
| 5,305,001 | A | 4/1994 | Wong et al. |
| 5,568,160 | A | 10/1996 | Collins |
| 5,936,579 | A | 8/1999 | Kapitsyn et al. |
| 6,034,647 | A | 3/2000 | Paul et al. |
| 6,118,412 | A | 9/2000 | Chen |
| 6,201,508 | B1 | 3/2001 | Metzen et al. |
| 6,225,960 | B1 | 5/2001 | Collins |
| 6,411,174 | B1 | 6/2002 | Crouch et al. |
| 6,507,323 | B1 | 1/2003 | West |
| 6,522,215 | B2 | 2/2003 | Enokuma |
| 6,563,398 | B1 | 5/2003 | Wu |
| 6,661,390 | B2 | 12/2003 | Gau et al. |
| 6,839,037 | B1 | 1/2005 | Stokes et al. |
| 6,861,997 | B2 | 3/2005 | Mahon |
| 7,132,907 | B2 | 11/2006 | Chambelin et al. |
| 7,564,421 | B1 | 7/2009 | Edwards et al. |
| 7,927,402 | B1 | 4/2011 | Grzeslak et al. |
| 8,077,103 | B1 | 12/2011 | Acosta et al. |
| 8,354,969 | B2 | 1/2013 | Lin et al. |
| 8,477,075 | B2 | 7/2013 | Seifried et al. |
| 8,525,616 | B1 | 9/2013 | Shaw et al. |
| 8,558,746 | B2 | 10/2013 | Thomson et al. |
| 8,587,492 | B2 | 11/2013 | Runyon |
| 8,988,300 | B2 | 3/2015 | Runyon et al. |
| 8,995,838 | B1 | 3/2015 | Schaffner et al. |
| 9,000,861 | B2 | 4/2015 | Ado et al. |
| 9,130,278 | B2 | 9/2015 | Palevsky et al. |
| 9,184,482 | B2 | 11/2015 | Runyon et al. |
| 9,640,847 | B2 | 5/2017 | Jensen et al. |
| 9,735,475 | B2 | 8/2017 | Anderson et al. |
| 9,768,494 | B2 | 9/2017 | Johansson et al. |
| 9,859,597 | B2 | 1/2018 | Jensen et al. |
| 10,020,554 | B2 | 7/2018 | Parekh et al. |
| 2002/0097111 | A1 | 7/2002 | Holden et al. |
| 2002/0171596 | A1 | 11/2002 | Em et al. |
| 2003/0067367 | A1 | 4/2003 | Volman |
| 2003/0117243 | A1* | 6/2003 | Cooper ..... H01P 1/207 333/208 |
| 2004/0178863 | A1 | 9/2004 | Chan et al. |
| 2006/0226931 | A1 | 10/2006 | Tavassoli Hozouri |
| 2007/0182507 | A1 | 8/2007 | Chang et al. |
| 2009/0179809 | A1 | 7/2009 | Jan |
| 2010/0102899 | A1 | 4/2010 | Engel |
| 2010/0259346 | A1 | 10/2010 | Runyon |
| 2011/0043422 | A1 | 2/2011 | Lin et al. |
| 2011/0061539 | A1 | 3/2011 | Lam et al. |
| 2011/0156838 | A1 | 6/2011 | Huang et al. |
| 2011/0267250 | A1 | 11/2011 | Seifried et al. |
| 2012/0218160 | A1 | 8/2012 | Montgomery et al. |
| 2013/0141300 | A1 | 6/2013 | Runyon et al. |
| 2013/0278474 | A1 | 10/2013 | Lenormand et al. |
| 2013/0321229 | A1 | 12/2013 | Klefenz et al. |
| 2014/0254976 | A1 | 9/2014 | Thomson et al. |
| 2015/0180111 | A1 | 6/2015 | Runyon et al. |
| 2016/0020525 | A1 | 1/2016 | Runyon et al. |
| 2016/0351984 | A1 | 12/2016 | Jensen et al. |
| 2017/0047661 | A1 | 2/2017 | Parekh et al. |
| 2017/0141478 | A1 | 5/2017 | Jensen |
| 2017/0263991 | A1 | 9/2017 | Jensen et al. |

FOREIGN PATENT DOCUMENTS

| | | | |
|---|---|---|---|
| EP | 0228743 | A1 | 7/1987 |
| EP | 1930982 | B1 | 10/2010 |
| EP | 2237371 | A2 | 10/2010 |
| EP | 2287969 | A1 | 2/2011 |
| EP | 2654126 | A1 | 10/2013 |
| EP | 3098899 | A1 | 11/2016 |
| JP | 2007329741 | A1 | 12/2007 |
| KR | 101228014 | B1 | 2/2013 |
| WO | WO-2002/009227 | A1 | 1/2002 |
| WO | WO-2006/061865 | A1 | 6/2006 |
| WO | WO-2008/069369 | A1 | 6/2008 |
| WO | WO-2014/108203 | A1 | 7/2014 |

OTHER PUBLICATIONS

Chang et al., "Dual-function circular polarization converter for microwave/plasma processing systems", Review of Scientific Instruments, vol. 70, No. 2, Feb. 1999, pp. 1530-1534.

Chen et al., "An Ultra Wide Bard Power Divider/Combiner Based on Y-structure Waveguide", 2010 International Conference on Microwave and Millimeter Wave Technology (ICMMT), IEEE, May 2010, pp. 853-855.

Chou et al., "A Septum Polarizer by Inserting Additional Stubs for its Applications in the CP Horn Antennas", International Symposium on Antenna and Propagation, 2008, 4 pgs.

Christopher et al., "Design Aspects of Compact High Power Multiport Unequal Power Dividers", IEEE International Symposium on Phased Array Systems and Technology, IEEE, Oct. 1996, pp. 63-67.

Dittloff et al., "Computer Aided Design of Optimum E- or H-Plane N-Furcated Waveguide Power Dividers", 17th European Microwave Conference, Sep. 1987, pp. 181-186.

Dudko et al., "A Wide Band Matching of H-plane Tee", 6th International Conference on Mathematical Methods in Electromagnetic Theory, Sep. 1996, pp. 309-312.

Elliott, "Two-Mode Waveguide for Equal Mode Velocities", IEEE Transactions on Microwave Theory and Techniques, vol. MTT-16, No. 5, May 1968, pp. 282-286.

Galuščák, "Advanced Design of Reflector Based Antennas", Doctoral Thesis Statement, Czech Technical University in Prague, Jun. 2011, 19 pgs.

Galuščák et al., "Compact Circular/Linear Polarization Dual-Band Prime-Focus Feed for Space Communication", International Journal of Antennas and Propagation, vol. 2012, Article ID 860951, http://dx.doi.org/10.1155/2012/860951, Apr. 2012, 7 pgs.

Gardner et al., "Mode Matching Design of Three-Way Waveguide Power Dividers", IEE Colloquium on Advances in Passive Microwave Components, May 1997, pp. 5/1-5/4, 4 pgs.

Goldfarb, "A Recombinant, In-Phase Power Divider", IEEE Transactions on Microwave Theory and Techniques, vol. 39, No. 8, Aug. 1991, pp. 1438-1440.

Henderson et al., "Compact Circularly-Polarised Coaxial Feed", Ninth International Conference on Antennas and Propagation (Conf. Publ. No. 407), Apr. 4-7, 1995, pp. 327-330.

(56) References Cited

OTHER PUBLICATIONS

Hersey et al., "Self Regenerating Desiccant for Water Management in External Aircraft Electronics", 1999 IEEE Aerospace Conference, Mar. 1999, pp. 183-191.
Ihmels et al., "Field Theory Design of a Corrugated Septum OMT", IEEE MTT-S International Microwave Symposium Digest, Jun. 14-18, 1993, pp. 909-912.
Joubert et al., "Design of Unequal H-plane Waveguide Power Dividers for Array Appiications", Antennas and Propagation Society International Symposium, IEEE, Jul. 1996, pp. 1636-1639.
Kerr, "Elements for E-Plane Split-Block Waveguide Circuits", http://legacy.nrao.edu/alma/memos/html-memos/alma381/memo381.pdf, Jul. 5, 2001, 9 pgs.
Kim et al., "Design of High Power Split Waveguide Array in W-band", IEEE, Sep. 2009, 2 pgs.
Mestezky et al., "Unequal, Equi-phase, 1:N Power Divider Based on a Sectoral Waveguide", International Journal of Microwave and Optical Technology, vol. 4, No. 3, May 2009, pp. 170-174.
Panda et al., "Multiple Cavity Modeling of a Feed Network for Two Dimensional Phased Array Application", Progress in Electromagnetics Research Letters, vol. 2, 2008, pp. 135-140.
Purdy et al., "Bandwidth Enhancement Technique for a Square Waveguide Phased Array Element", IEEE Antennas and Propagation Society International Symposium, Jul. 1999, pp. 138-141.
Rebollar et al., "Design of a Compact Ka-Band Three-Way Power Divider", IEEE, Jun. 1994, pp. 1074-1077.
Sehm et al., "A large planar antenna consisting of an array of waveguide fed horns", 26th European Microwave Conference, Sep. 1996, pp. 610-613.
Sehm et al., "A Large Planar 39-GHz Antenna Array of Waveguide-Fed Horns", IEEE Transactions on Antennas and Propagation, vol. 46, No. 8, Aug. 1998, pp. 1189-1193.
Sehm et al., "A 36 GHz Horn Antenna Array", 28th European Microwave Conference, Oct. 1998, pp. 184-189.
Sehm et al., "A High-Gain 58-GHz Box-Horn Array Antenna with Suppressed Grating Lobes", IEEE Transactions on Antennas and Propagation, vol. 47, No. 7, Jul. 1999, pp. 1125-1130.
Sehm et al., "A 64-element Array Antenna for 58 GHz", IEEE, Jul. 1999, pp. 2744-2747.
Soroka et al., "Simulation of multichannel waveguide power dividers", MSMW '98 Third International Kharkov Symposium, Physics and Engineering of Millimeter and Submillimeter Waves, Sep. 1998, pp. 634-635.
Wade, "Septum Polarizers and Feeds", W1GHz, http://www.w1ghz.org/antbook/conf/SEPTUM.pdf, 2003, 20 pgs.
Wollack, "On the Compensation of E-Plane Bifrucations in Rectangular Waveguide", NRAO, Electronics Division Technical Note No. 181, Oct. 20, 1997, 8 pgs.
Yang et al., "Synthesis of a Compound T-Junction for a Two-Way Splitter with Arbitrary Power Ratio", 2005 IEEE MTT-S International Microwave Symposium Digest, Jun. 2005, pp. 985-988.
U.S. Appl. No. 14/868,627, filed Sep. 29, 2015, 30 pgs.
Non-Final Office Action mailed in U.S. Appl. No. 14/940,333 dated Jan. 9, 2018, 10 pgs.
Non-Final Office Action mailed in U.S. Appl. No. 14/948,179 dated Nov. 24, 2017, 7 pgs.
U.S. Appl. No. 15/482,311, filed Apr. 7, 2017, 41 pgs.
Extended European Search Report mailed in European Patent Application No. 16171283.1 dated Oct. 14, 2016, 8 pgs.
Examination Report mailed in European Patent Application No. 16171283.1 dated Feb. 15, 2018, 5 pgs.
Notice of Allowance mailed in U.S. Appl. No. 14/948,179 dated Apr. 4, 2018, 7 pgs.
Notice of Allowance mailed in U.S. Appl. No. 14/868,627 dated May 22, 2018, 9 pgs.
Notice of Allowance and Examiner-Initiated Interview Summary mailed in U.S. Appl. No. 14/940,333 dated May 25, 2018, 10 pgs.
U.S. Appl. No. 16/031,787, filed Jul. 10, 2018, 39 pgs.
Non-Final Office Action mailed in U.S. Appl. No. 15/482,311 dated Jul. 16, 2018, 6 pgs.

* cited by examiner

100

PARTIAL DIELECTRIC LOADED SEPTUM POLARIZER

CROSS-REFERENCE TO RELATED APPLICATIONS

This application is a continuation of U.S. patent application Ser. No. 15/482,130, filed 7 Apr. 2017, entitled "Partial Dielectric Loaded Septum Polarizer", which is a continuation-in-part of U.S. patent application Ser. No. 14/723,272, filed 27 May 2015, entitled "Partial Dielectric Loaded Septum Polarizer", each of which is incorporated by reference herein.

FIELD

The present disclosure relates generally to waveguide devices.

BACKGROUND

Various radio frequency (RF) antenna devices include an array of waveguide radiating located at the antenna aperture. The antenna can be suitable for transmitting and/or receiving a signal. RF antennas may often comprise polarizers, such as a waveguide polarizer or a septum polarizer. Polarizers are useful, for example, to convert a signal between dual circular polarization states in a common waveguide and two signal components in individual waveguides that correspond to orthogonal circular polarization signals. However, in an antenna with an array of radiating elements that are closely packed, conventional waveguide polarizers are unsuitable because they are too large/bulky. A septum polarizer is more compact, however, the septum polarizer is typically unsuitable for a wide bandwidth (e.g., arrays having wide frequency range spanning a range of 1.75:1), and that have a grating sidelobe restriction on the array lattice at the high end of the frequency range. Thus, a need exists, for an antenna array of waveguide radiating elements, for compact, wide-bandwidth, high performance solutions.

SUMMARY

In an example embodiment, a waveguide device comprises: a first common waveguide; a polarizer section, the polarizer section including a conductive septum dividing the first common waveguide into a first divided waveguide portion and a second divided waveguide portion; a second waveguide coupled to the first divided waveguide portion of the polarizer section; a third waveguide coupled to the second divided waveguide portion of the polarizer section; and a dielectric insert. The dielectric insert includes a first dielectric portion partially filling the polarizer section. The conductive septum and the dielectric portion convert a signal between a polarized state in the first common waveguide and a first polarization component in the second waveguide and a second polarization component in the third waveguide.

BRIEF DESCRIPTION OF THE DRAWINGS FIGURES

DETAILED DESCRIPTION

Figure 1:
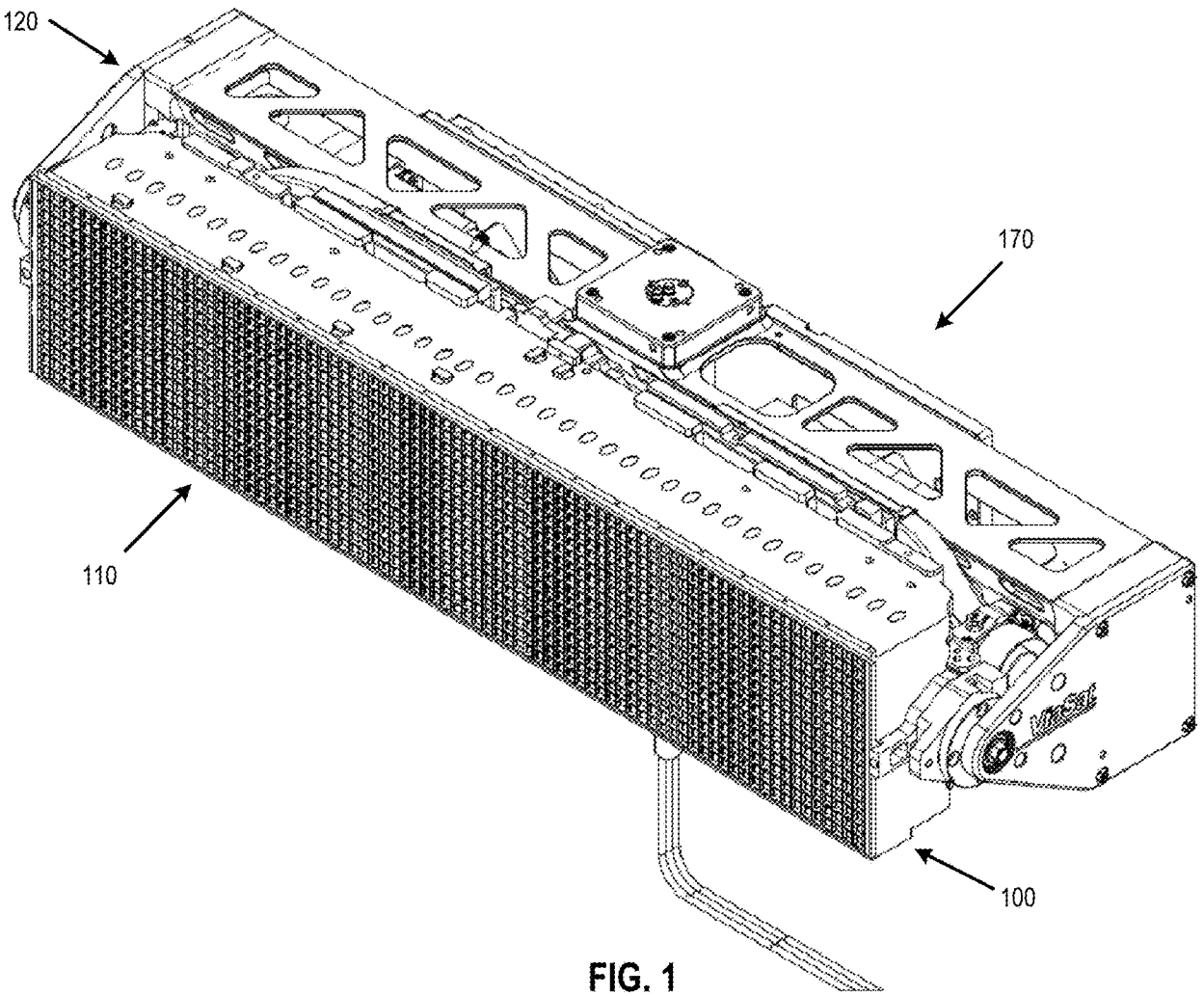
FIG. 1 is a perspective view of an example antenna system.

Reference will now be made to the example embodiments illustrated in the drawings, and specific language will be used herein to describe the same. It will nevertheless be understood that no limitation of the scope of the disclosure is thereby intended. Alterations and further modifications of the features illustrated herein, and additional applications of the principles illustrated herein, which would occur to one skilled in the relevant art and having possession of this disclosure, are to be considered within the scope of the disclosure.

FIG. 1 is a perspective view of an example antenna system 170. In the illustrated embodiment, antenna system 170 includes a waveguide device 100. In the illustrated embodiment, waveguide device 100 is an antenna array that includes a partially dielectric loaded septum polarizer (not shown) described in more detail below. Alternatively, the partially dielectric loaded septum polarizer can be implemented in other types of waveguide devices. The frequency of operation and application of the waveguide device 100 can vary from embodiment to embodiment. In some embodiments, waveguide device 100 is operable to facilitate Ka-band satellite communication (SATCOM) applications that may involve simultaneous receive and transmit and dual polarized operation at diverse frequency bands, with a high level of integration to achieve compactness and light weight. More generally, the waveguide device 100 can operate at Ka band, Ku band, X band, and/or other frequency band(s), and may be used in one or more applications such as in air-borne, terrestrial, and/or other applications. The waveguide device 100 can facilitate transmitting in a first band and receiving in a second band with a wide spread between the two bands. Various examples herein illustrate example embodiments that can have dual frequency bands of 17.7-21.2 GHz (RX) and 27.5-31.0 GHz (TX) for Ka band.

In the illustrated embodiment in which the waveguide device 100 is an antenna array, the antenna array includes an antenna aperture 110 having an array of radiating elements. Each radiating element can include a partially dielectric loaded septum polarizer as described herein. The partially dielectric loaded septum polarizer can convert a signal between dual polarization states (at the antenna aperture 110) and two signal components that correspond to orthogonal polarization signals (in two individual waveguides, respectively). The partially dielectric loaded septum polarizer can for example convert the signal between dual circular polarization states and two signal components that correspond to orthogonal circular polarization signals. As another example, the partially dielectric loaded septum polarizer can for example convert the signal between dual linear polarization states and two signal components that correspond to orthogonal linear polarization signals. Thus, from a receive perspective, the septum polarizer can be thought of as taking energy of a first polarization and substantially transferring it into a first waveguide, and taking energy of a second polarization orthogonal to the first polarization and substantially transferring it into a second waveguide. Waveguide device 100 can further include a waveguide feed network (not shown) that combines signals of similar polarization from the individual antenna elements to produce a single pair of orthogonal polarization received signals. Alternatively, the various signals may be combined or divided in other ways. This pair of signals can be provided to a Low Noise Block amplifier in a transceiver for amplification and downconversion. Conversely, from a transmit perspective, signals corresponding to orthogonal polarizations at the waveguide aperture can be provided to the waveguide device 100 at input ports and the signals are divided and provided to the individual radiating elements, wherein the septum polarizer facilitates converting the two orthogonal polarization signal components to a signal having dual polarization states.

Waveguide device 100 further comprises a dielectric insert (not shown). The dielectric insert is inserted in septum polarizer of the radiating element, as discussed further below. The dielectric insert can provide improved performance of the antenna or other waveguide device in which the partially loaded septum polarizer described herein is implemented. In embodiments in which the waveguide device 100 is an antenna, the improvement generally arises where the antenna requirements include grating lobe free operation at the highest operating frequency, but also operate over a wide bandwidth. Designing a lattice array of radiating elements that are grating lobe free (the forward hemisphere of the antenna pattern has no grating lobes) can be accomplished with an element spacing of equal to or less than one wavelength at the highest operating frequency for a non-electrically steered antenna. Thus, the desire to suppress the grating lobes at high frequency drives the designing of small radiating elements that are spaced closely together. However, this can create difficulties at efficiently radiating at the lower end of the operating bandwidth in embodiments in which the bandwidth is large. Without the dielectric loading, at the lower end of the frequency of operation of the waveguide device 100, the radiating element may approach cutoff conditions and/or not propagate energy efficiently. Loading the radiating element with a dielectric material improves the transmission at the lower frequency end of the operating bandwidth. Thus, the dielectric insert partially loads the radiating elements enough to facilitate communication at the lower frequencies, but not so much as to over-mode at the higher frequencies of the operational bandwidth. The dielectric insert is described in more detail herein.

In addition, the antenna array can be a subcomponent that can be positioned by an antenna pointing system 120. The antenna pointing system 120 can be configured to point the antenna array at a satellite (not shown) or other communication target. In the illustrated embodiment, the antenna pointing system 120 can be an elevation-over-azimuth (EL/AZ) two-axis positioner. Alternatively, the antenna pointing system 120 may include other mechanisms.

Figure 2A:
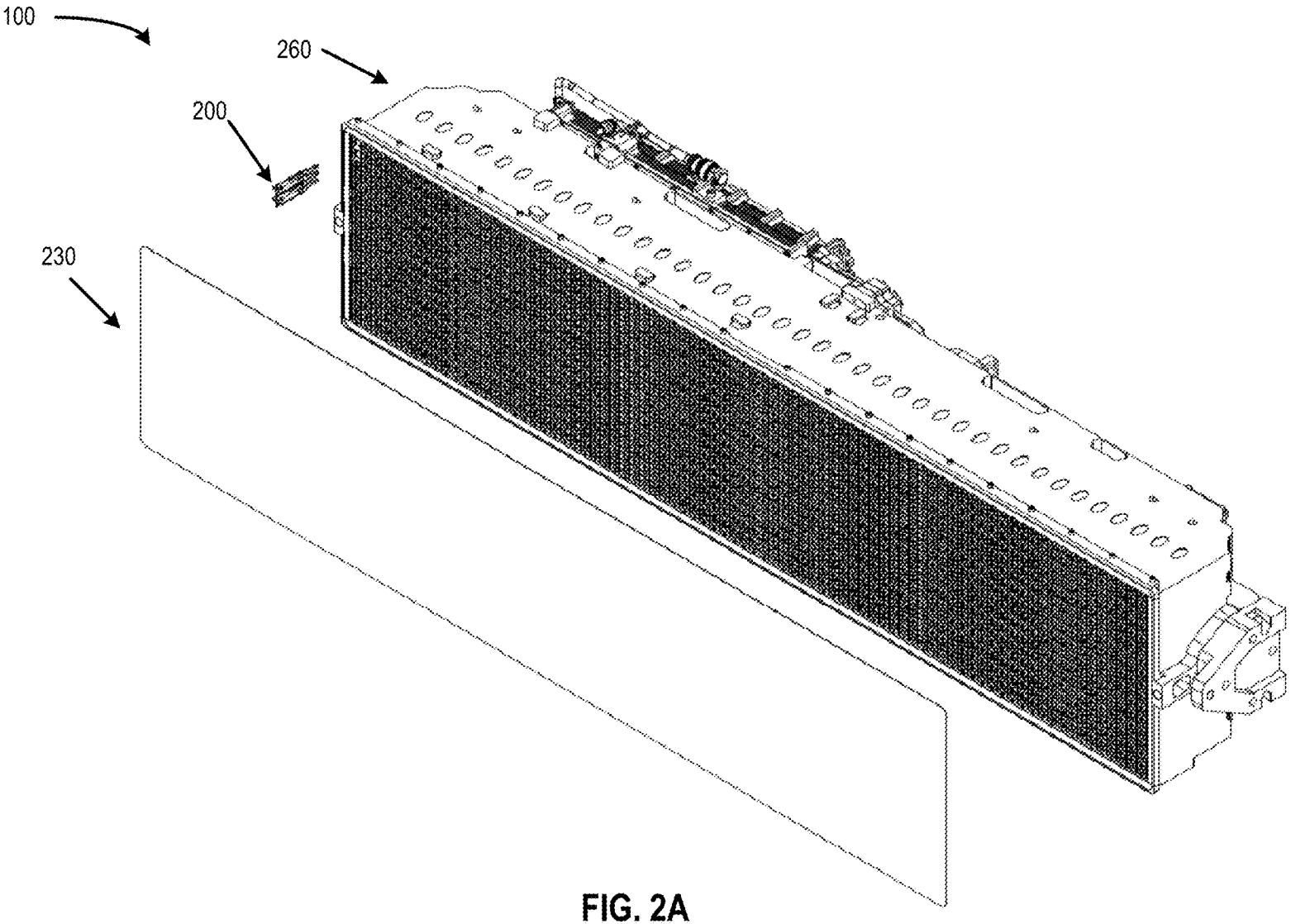
FIG. 2A is an exploded perspective view of a waveguide device and an example dielectric insert.

FIG. 2A is an exploded perspective view of the waveguide device 100 and example dielectric insert 200. In the illustrated embodiment, waveguide device 100 comprises an azimuth and elevation combiner/divider structure 260, dielectric insert 200, and an aperture close out 230. The azimuth and elevation combiner/divider structure 260 can comprise any suitable number of radiating elements, such as, for example, 500-1500 radiating elements.

As discussed above, the azimuth and elevation combiner/divider structure 260 can comprise a network of waveguides to combine (in a receive embodiment) a first RF signal from a plurality of radiating elements into a first RF signal, and to combine a second RF signal from the plurality of radiating elements into a second RF signal. The azimuth and elevation combiner/divider structure 260 can comprise multiple beam forming networks stacked vertically on top of each other forming a low loss, compact, planar, and light weight beam forming network.

A dielectric insert 200, shown here in a partially exploded perspective view, is inserted into the radiating element. In the illustrated embodiment, two dielectric inserts 200 are connected to each other, such that the pair of connected dielectric inserts 200 are each inserted into a pair of radiating elements at the same time, for ease of installation. In an alternative embodiment, a separate dielectric insert 200 is inserted in each radiating element.

Aperture close-out 230 can be connected to the face of the azimuth and elevation combiner/divider structure 260. The aperture close-out 230 can comprise any RF window having sufficiently low dielectric and loss tangent properties, such as, for example Nelco 9200, Neltec NY9220, Teflon PCB routed laminated with pressure sensitive adhesive, or other suitable materials with similar RF properties. For example, in some embodiments in which the waveguide device 100 operates at Ka band, polytetrafluoroethylene (PTFE) can be used. Other materials can be used for Ku-band and X-Band such as for example thermoset type resins with woven glass reinforcement. The aperture close-out 230 can be any material suitably configured to create an environmental seal over the radiating elements and dielectric inserts 200 (typ.) to protect the interior air cavity of the azimuth and elevation combiner/divider structure 260 from moisture or debris, while still allowing the RF signals to pass through. In the illustrated embodiments, the dielectric inserts are proud, and the metal frame is made proud too. Therefore, in these embodiments, the frame is sealed to the aperture close-out 230. In an alternative embodiment, the aperture close-out 230 is flush mounted.

Figure 2B:
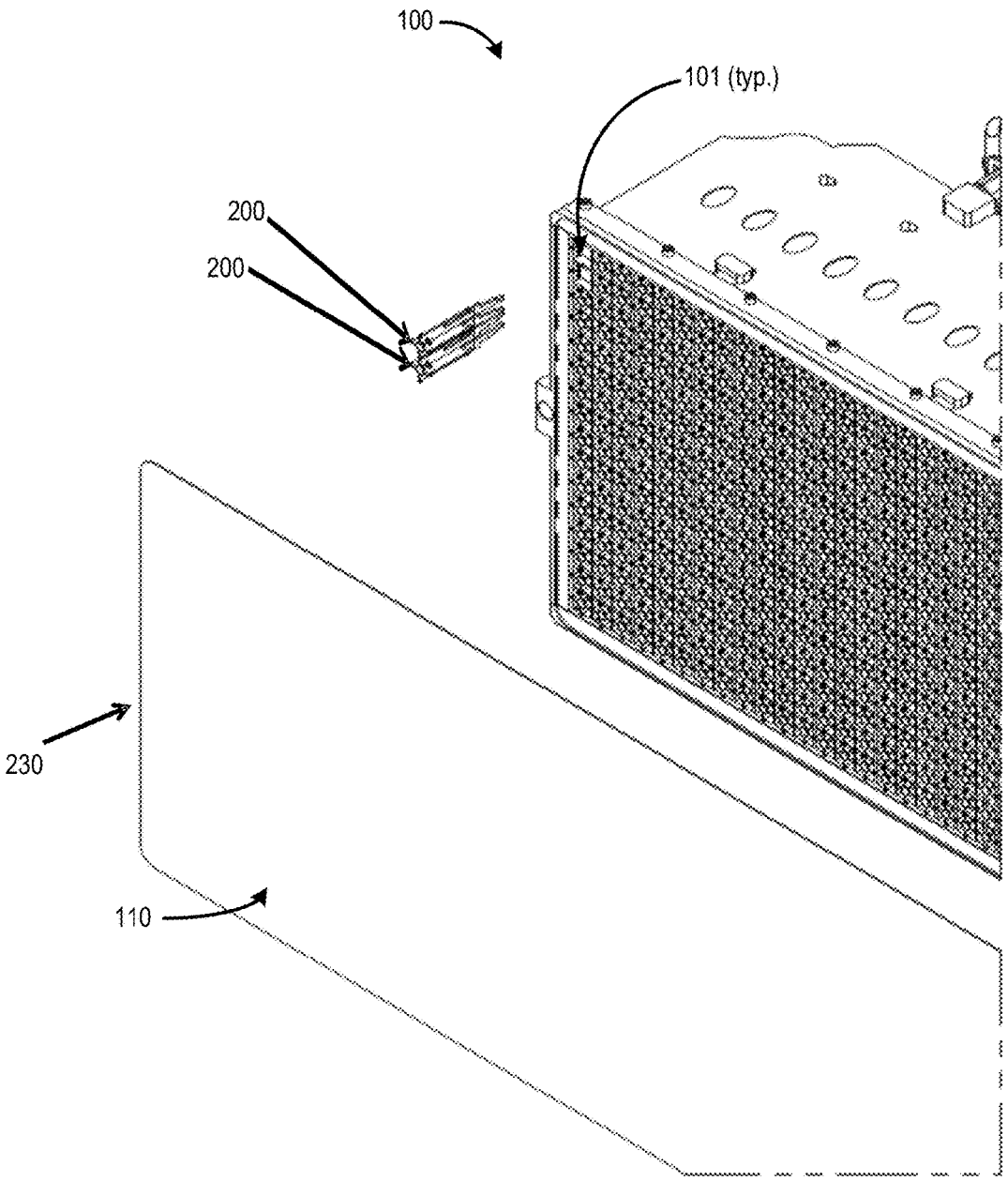
FIG. 2B is a close-up partially exploded perspective view of the waveguide device including an aperture close-out, dielectric insert (two connected dielectric inserts shown in exploded view), and radiating elements.

FIG. 2B is a close-up partially exploded perspective view of the waveguide device 100, including the aperture close-out 230, dielectric insert 200 (two connected dielectric inserts shown in exploded view), and radiating elements 101. In the illustrated embodiment, waveguide device 100 comprises an antenna aperture 110 comprising an array of radiating elements 101. Each dielectric insert 200 is configured to be inserted into a radiating element 101. In the illustrated embodiments, a connected pair of dielectric inserts 200 is configured to be inserted into a pair of radiating element 101 at the same time. In alternative embodiments, a single dielectric insert 200 is inserted individually in a single radiating element 101. The dielectric insert 200 is configured to be inserted into the radiating element 101 from the aperture, in the direction of the receive signal path for the waveguide device 100.

The material and dielectric constant of the dielectric insert 200 can vary from embodiment to embodiment. In some embodiments, the dielectric constant of material of the dielectric insert is between approximately 2.0 and 3.6, inclusive. Alternatively, the dielectric constant may be above or below that range. In some embodiments, the dielectric insert 200 can comprise a molded plastic, poly-4 methylpentene resin known under the trade name TPX and resin manufactured by Mitsui Plastics in Japan, an injection molded material. In some alternative embodiments, the dielectric insert 200 can be molded using a cyclic olefin copolymer (COC) such as TOPAS® manufactured by Topas Advanced Polymers GmbH in Germany. As another example, the dielectric insert 200 can be Ultem (polyetherimide) manufactured by Saudi Basic Industries Corp. (SABIC). In some embodiments, dielectric insert 200 can be formed completely of a single piece of dielectric material. In other embodiments, dielectric insert 200 comprises more than one type of material, wherein at least one portion is a dielectric material. Further, dielectric insert 200 may include selectively plated features of a conducting material such as copper, silver, rhodium, or other suitable electrical conductor.

Figure 2C:
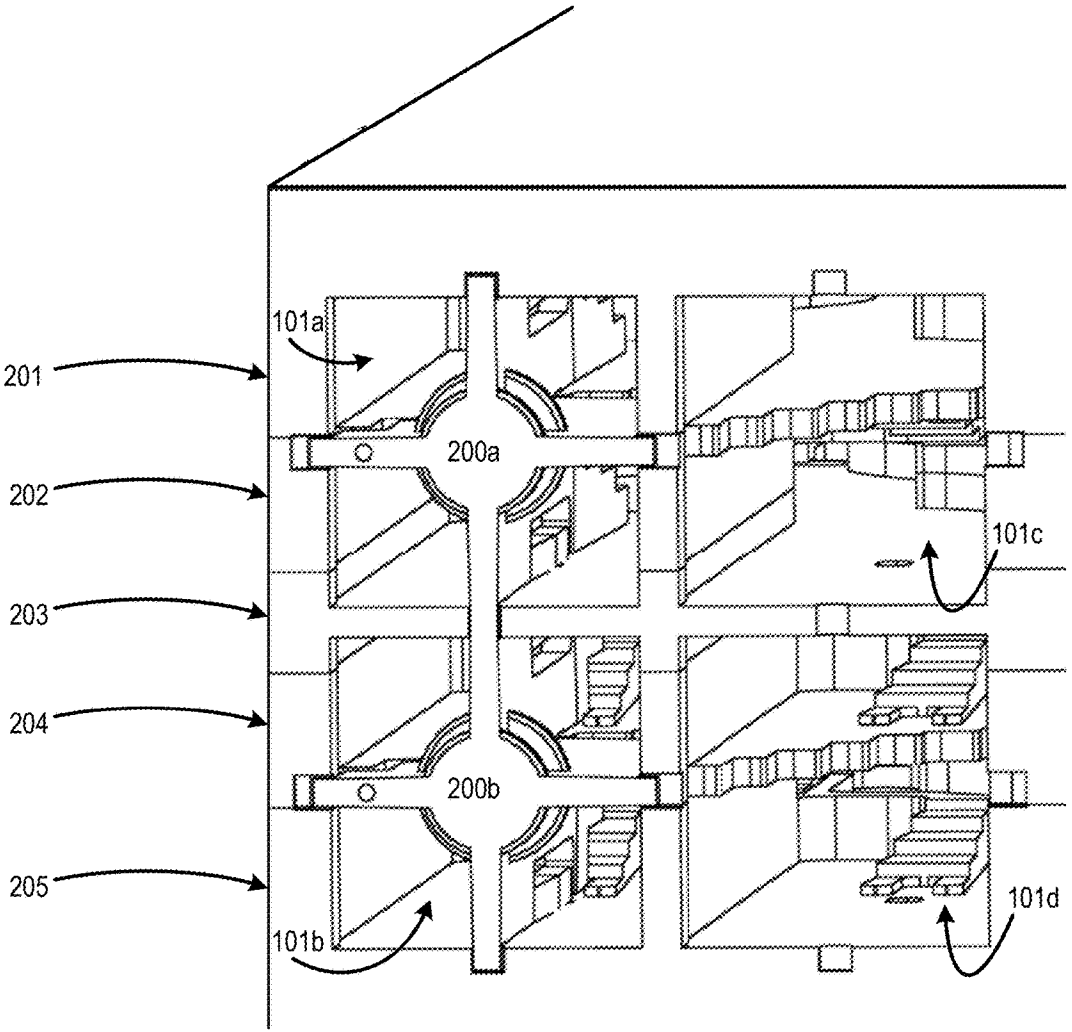
FIG. 2C is a close up perspective view of a portion of the waveguide device showing four radiating elements.

FIG. 2C is a close-up perspective view of a portion of waveguide device 100 showing four radiating elements 101*a*-101*d*. In the illustrated embodiment, the waveguide device 100 comprises five stacked layers: first layer 201, second layer 202, third layer 203, fourth layer 204, and fifth layer 205, each overlaying the other in that order. However, any number of layers and method of forming the waveguide device 100 can be used, and the illustrated embodiment is merely by way of example. In the illustrated embodiment, a dielectric insert 200*a* is inserted into radiating element 101*a* and a dielectric insert 200*b* is inserted into radiating element 101*b*. In the illustrated embodiment, dielectric insert 200*a* and dielectric insert 200*b* are connected to form a unitary dielectric insert. The connection of dielectric insert 200*a* and dielectric insert 200*b* facilitates reducing the number of part insertion operations into waveguide device 100. An insertion tool (not shown) is designed in a corresponding manner to facilitate a single insertion of dielectric inserts 200*a* and 200*b* into radiating elements 101*a* and 101*b* simultaneously. The other two dielectric inserts are not shown in FIG. 2C to improve visibility of the components of waveguide device 100.

Figure 3A:
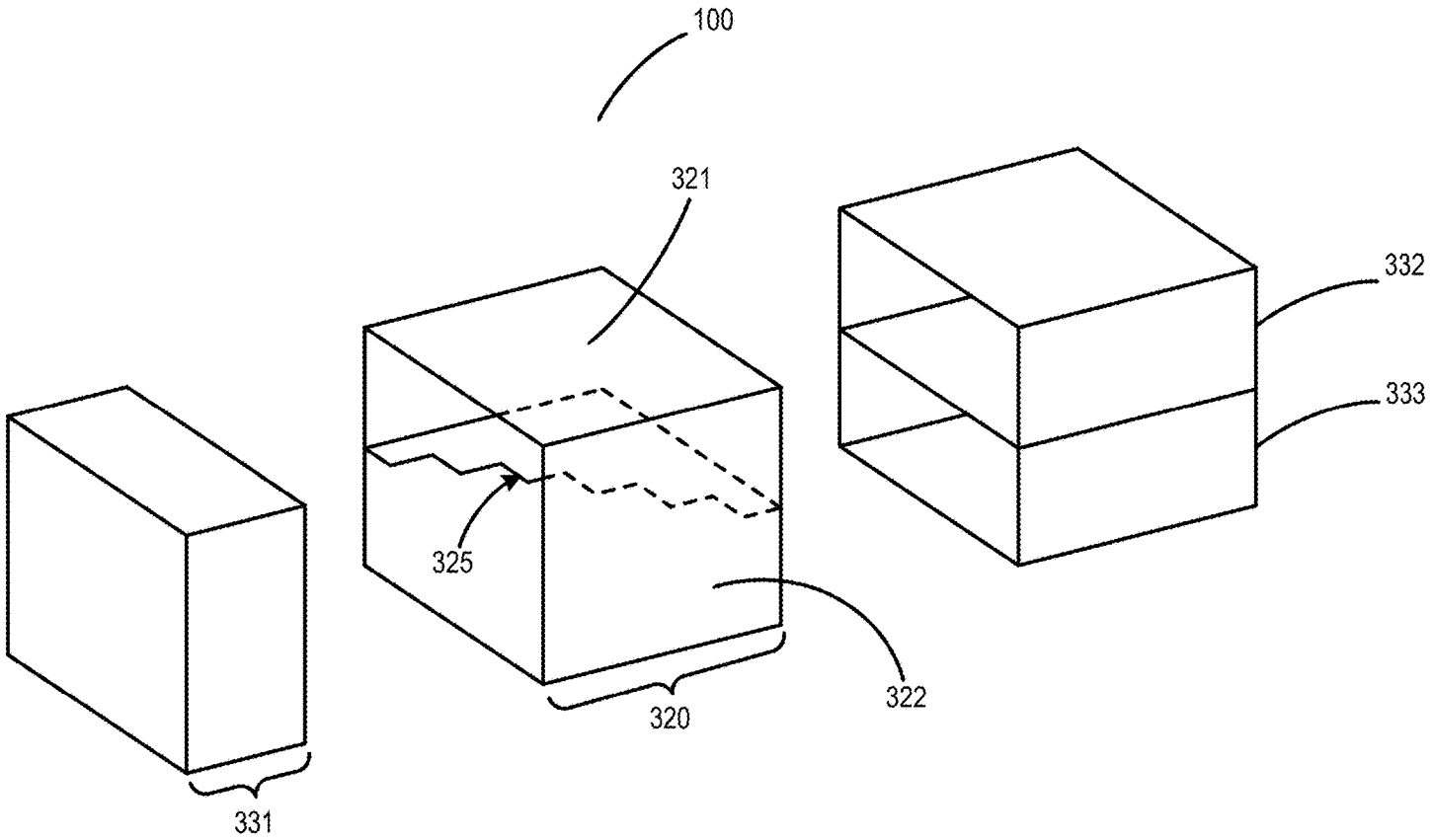
FIG. 3A is a perspective, exploded, simplified view of a portion of a first embodiment of the waveguide device.

FIG. 3A is a perspective, exploded, simplified view of a portion of a first embodiment of the waveguide device 100. In the illustrated embodiment, waveguide device 100 comprises a first common waveguide 331, a polarizer section 320, a second waveguide 332 and a third waveguide 333. Polarizer section 320 further comprises a conductive septum 325. The dielectric insert discussed with respect to FIGS. 2A-2C are not shown in FIGS. 3A and 3B, for clarity. Conductive septum 325 and the portion of the dielectric insert corresponding to the polarizer section 320 may divide the polarizer section 320 into a first divided waveguide portion 321 and a second divided waveguide portion 322. First common waveguide 331 is coupled to the polarizer section 320 on a first end of the polarizer section 320. Thus, conductive septum 325, in conjunction with a portion of the dielectric insert, can be thought of as dividing the first common waveguide 331 into first divided waveguide portion 321 and second divided waveguide portion 322. Second waveguide 332 is coupled to the first divided waveguide portion 321 on a second end of the polarizer section 320, opposite the first end of the polarizer section 320. Third waveguide 333 is coupled to the second divided waveguide portion 322 of the polarizer section 320 on the second end of the polarizer section 320. Thus, in an example embodiment, the polarizer section 320, comprising both the conductive septum 325 and a portion of the dielectric insert (not shown), can convert a signal between dual polarization states in first common waveguide 331 and two signal components in individual second and third waveguides (332, 333) that correspond to orthogonal polarization signals. This facilitates simultaneous dual polarized operation. For example, from a receive perspective, the polarizer section 320 can be thought of as receiving a signal at first common waveguide 331, taking the energy corresponding to a first polarization of the signal and substantially transferring it into the second waveguide 332, and taking the energy corresponding to a second polarization of the signal and substantially transferring it into the third waveguide 333.

Figure 3B:
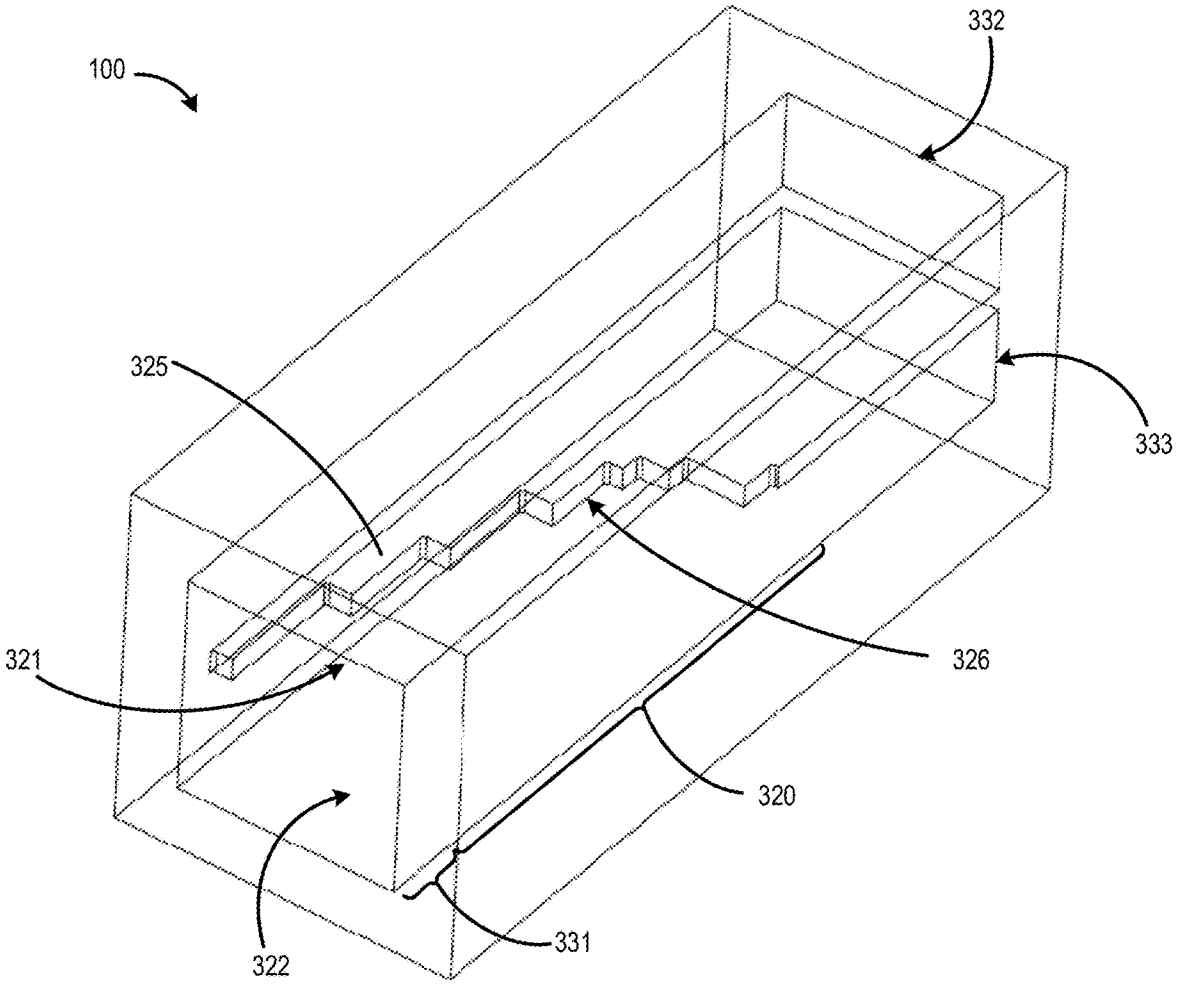
FIG. 3B is a perspective view of the first embodiment of the waveguide device.

FIG. 3B is a perspective view of the first embodiment of the waveguide device 100. The waveguide device 100 is illustrated with the dielectric insert omitted for clarity. As briefly discussed above, in an additional embodiment, the first common waveguide 331 is coupled to the polarizer section 320, which is configured to perform polarization conversion. The conductive septum 325 and a dielectric portion (discussed below) of the dielectric insert convert a signal between dual polarization states in the first common waveguide 331 and a first polarization component in the second waveguide 332 and a second polarization component in the third waveguide 333. The first polarization component corresponds to a first polarization at the antenna aperture 110, and the second polarization component corresponds to a second polarization at the antenna aperture 110.

The shape of the leading edge and thickness of the conductive septum 325 can vary from embodiment to embodiment. In some embodiments, the conductive septum 325 has a thickness of between 0.028 and 0.034 inches, for example being between 0.0305 and 0.0325 inches. Alternatively, other thicknesses may be used, depending on frequency of operation, packaging density, manufacturing and performance requirements. Conductive septum 325 can be made from electrically conductive material of aluminum, copper, brass, zinc, steel, or other suitable electrically conducting material that can be bonded or joined to the adjoining layers in the waveguide device 100. Moreover, any suitable conductive material or any suitable material coated in a conductive material may be used to form the conductive septum 325. In the illustrated embodiment, the conductive septum 325 comprises a shaped edge 326. In the illustrated embodiment, the shaped edge 326 comprises a plurality of steps, such as six steps. Moreover, the shaped edge 326 can have any suitable number of steps. In an alternative embodiment, the shaped edge 326 can have any other suitable shape, such as smooth.

In addition, although illustrated herein with the conductive septum 325 having the same orientation as other septums in other radiating elements 101 in the waveguide device 100, in other embodiments, some of the conductive septum 325 in waveguide device 100 are oriented 180 degrees (or stated otherwise, inverted) from other conductive septums. For example, a conductive septum 325 may be inverted from a conductive septum in an adjacent radiating element 101. In other embodiments, every other pair of radiating elements 101 is inverted.

As described in more detail below with respect to FIGS. 3C-3E, in some embodiments the waveguide device 100 includes one or more features within the polarizer section 320 that alters one mode of propagation relative to another mode of propagation, such as altering the waveguide cutoff value and/or altering the propagation constant of one mode of propagation differently than another mode of propagation. In other words, the one or more features alters a first propagation mode of a signal within the polarizer section 320 differently than a second propagation mode of the signal, as compared to omitting the one or more features. The one or more features may add degrees of freedom to the design of the waveguide device 100. This in turn can allow for designs to increase bandwidth margins, which may improve robustness to dimensional variations that may result from various manufacturing processes.

Figure 3C:
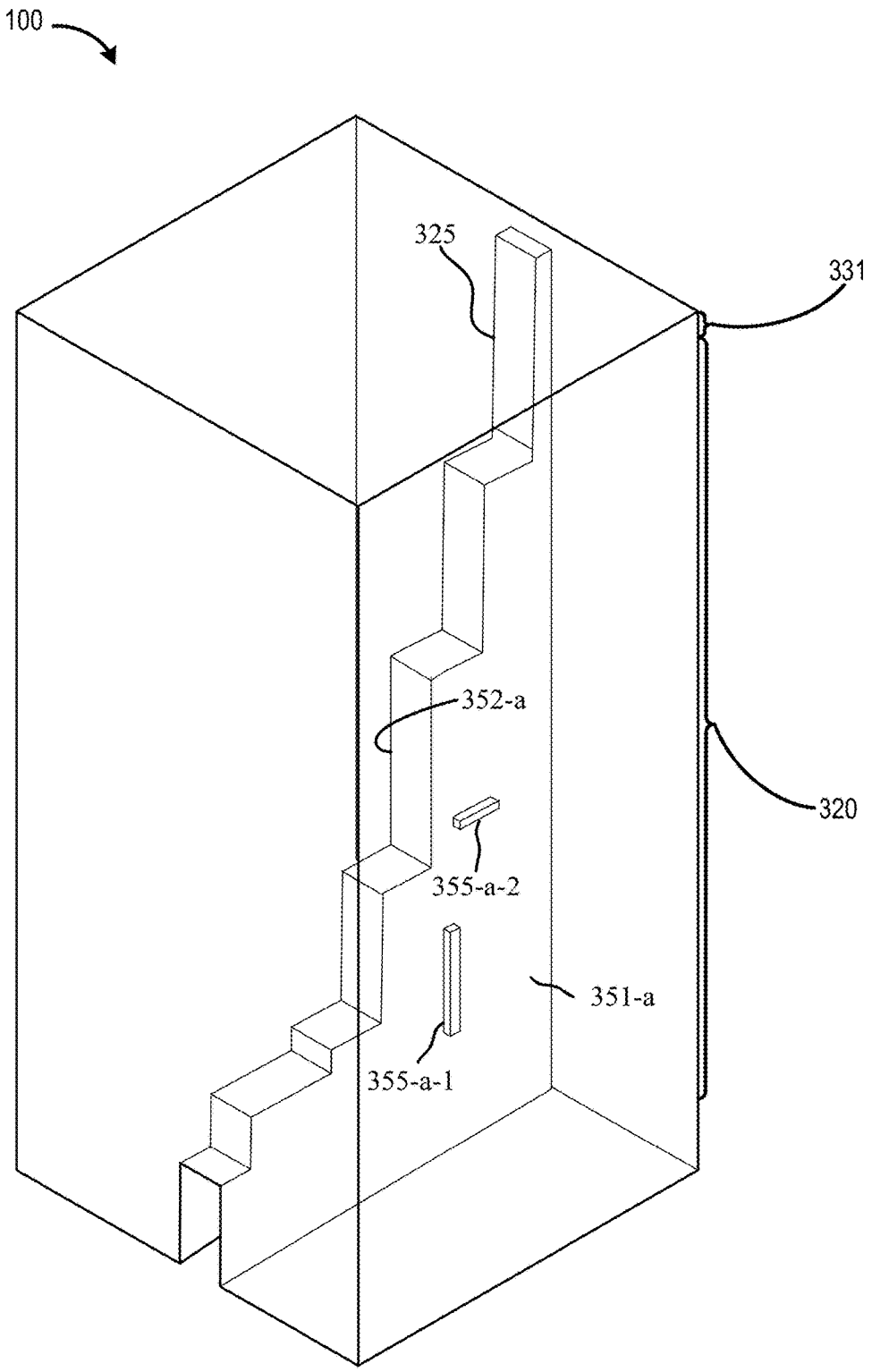
FIG. 3C is a perspective view of a second embodiment of the waveguide device.

FIG. 3C is a perspective view of a second embodiment of the waveguide device 100 with one or more features within the polarizer section 320. In the example of FIG. 3C, the one or more features are located on the conductive septum, and thus are referred to hereinafter after as septum features. The waveguide device 100 is illustrated with the dielectric insert omitted for clarity. As described in more detail below, the waveguide device 100 includes a septum feature, such as a ridge, on one or more surfaces of a conductive septum of a waveguide device including a polarizer section. For example, the waveguide device 100 may include one or more ridges on one or both of a first surface or a second surface of the conductive septum. The mode corresponding to the septum acting an E-plane ridge (e.g., the $TE_{01}$ mode) may have a reduced lower cutoff frequency than the orthogonal mode (e.g., $TE_{10}$ mode). The septum feature(s) described herein may create an artificial boundary condition (e.g., a surface impedance or perturbation) along the septum, which may alter the propagation constant in one or more portions of the polarizer section for the $TE_{10}$ mode. The different propagation constant created by the septum feature(s) may alter the propagation characteristics for the $TE_{10}$ mode without altering the propagation characteristics for the $TE_{01}$ mode. For example, the septum feature(s) may increase the conducting perimeter boundary length for the $TE_{10}$ mode to an extent similar to ridge loading provided by the septum to the $TE_{01}$ mode, thus equalizing the propagation constants for the $TE_{10}$ and $TE_{01}$ modes. As a result, the septum feature(s) provide an additional degree of freedom for achieving the desired phase relationship between the $TE_{10}$ and $TE_{01}$ modes. Using the additional degree of freedom, performance at the lower and/or higher operational frequencies can be improved, such that performance objectives such as a desired operational bandwidth, axial ratio (e.g., less than 1 dB), and/or cross-polarization discrimination may be achieved. For example, in dual-band operation, the axial ratio and cross-polarization discrimination may be improved in one or both of the lower frequency band or the higher frequency band. This also may provide increased bandwidth margins to allow for manufacturing tolerances. Although described with reference to dual-band operation, the septum feature(s) described herein also may be employed for the design of signal-band or multi-band waveguide devices to improve the performance in the single bandwidth (e.g., higher broadband performance, etc.).

Various parameters of each ridge (e.g., number, location, shape, size, spacing, etc.) may be determined according to a particular design implementation. Each ridge thus adds degrees of freedom to the design of a waveguide device, which may help with performance optimization and may increase the achievable performance. The septum features may be configured to lower the waveguide cutoff values and/or alter the propagation constant, which can provide improvements to the performance and/or design flexibility of the waveguide device. For example, the addition of one or more ridges may allow designs to increase bandwidth margins, which may improve robustness to dimensional variations that may result from various manufacturing processes. This may be beneficial, for example, in relatively high volume applications (e.g., where molding or casting may be employed) to achieve increased yields. Furthermore, an increased bandwidth margin may, for instance, improve the ability to design, manufacture, and/or operate a septum polarizer configured to convert the polarization of signals at more than one carrier signal frequency.

In the illustrated embodiment, the conductive septum 325 includes one or more ridges 355-*a* protruding from first and second surfaces 351-*a*, 352-*a* that are parallel to the central axis of the waveguide device 100 and extend between opposing sidewalls of the waveguide device 100. Specifically, as illustrated in the present example, the conductive septum 325 has a first ridge 355-*a*-1 projecting from a first surface 351-*a* of the conductive septum 325. Optionally, the conductive septum may have a second ridge 355-*a*-2 projecting from the first surface 351-*a*, or projecting from a second surface 352-*a*. Therefore the conductive septum 325 can have ridges 355-*a* on both the first surface 351-*a* and the second surface 352-*a* of the conductive septum 325, and/or multiple ridges 355-*a* on the same surface. Some or all of the ridges 355-*a* can have a longitudinal axis extending in a direction of the central axis, where the central axis is in a direction between the first common waveguide and the first and second divided waveguide portions.

In some examples, a one or more ridges 355-*a* can have a longitudinal axis in the direction of the central axis of the waveguide device 100 (i.e., the length dimension of the ridge is greater than the width dimension of the ridge and the height dimension of the ridge, such as illustrated by the first ridge 355*a*-1). Optionally, the waveguide device 100 may have one or more ridges 355-*a* that have a longitudinal axis in a direction non-parallel with central axis of the waveguide device 100.

Although multiple ridges 355-*a* are shown in the illustrated example, it should be understood that a single ridge 355-*a* may be formed on one or each of the first surface 351-*a* or the second surface 352-*a* of the conductive septum 325. Furthermore, the number of ridges 355-*a* on the first surface 351-*a* of the conductive septum 325 (e.g., zero, one or more) need not be equal to the number (e.g., zero, one or more) of ridges 355-*a* on the second surface 352-*a* of the conductive septum 325, nor do ridges 355-*a* need to be of the same size or shape.

In some examples, ridges 355-*a* are adjacent to stepped surfaces of the conductive septum 325. In other examples, one or more ridges 355-*a* can be coincident with both the conductive septum 325 and a sidewall of the waveguide device 100.

Figure 3D:
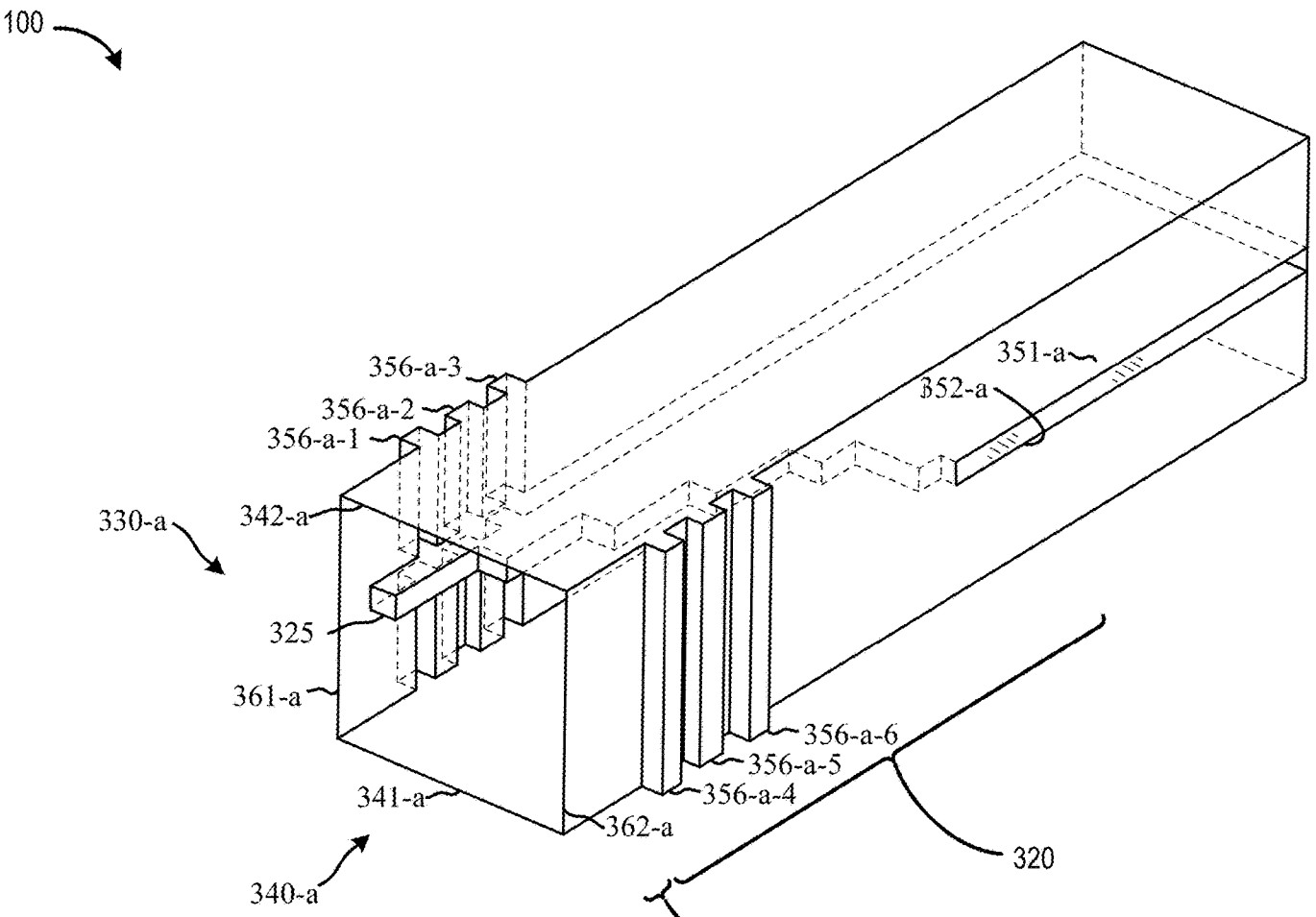
FIG. 3D is a perspective view of a third embodiment of the waveguide device.

FIG. 3D is a perspective view of a third embodiment of the waveguide device 100 with one or more features in the polarizer section. In the example of FIG. 3D, the one or more features are located on one or more sidewalls of the waveguide device 100, and thus hereinafter are referred to as sidewall features. The waveguide device 100 is illustrated with the dielectric insert omitted for clarity. In FIG. 3D, the waveguide device 100 includes a sidewall feature, such as a recess or protrusion, on one or both of a set of opposing sidewalls of the polarizer section 320. Various parameters of each sidewall feature (e.g., number, location, shape, size, spacing, etc.) may be determined according to a particular design implementation. Each sidewall feature thus adds degrees of freedom to the design of the waveguide device, which may help with performance optimization and may increase achievable performance. The sidewall features may be configured to lower the waveguide cutoff values and/or alter the propagation constant, which can provide improvements to the performance and/or design flexibility of the waveguide device 100. For example, the sidewall features may affect one mode of propagation relative to another mode of propagation due to the placement and characteristics of the sidewall features, which may allow a propagation-mode dependent cutoff frequency to be modified. The addition of one or more sidewall features may allow designs to increase bandwidth margins, which may improve robustness to dimensional variations that may result from various manufacturing processes. This may be beneficial, for example, in relatively high volume applications (e.g., where molding or casting may be employed) to achieve increased yields. Furthermore, an increased bandwidth margin may, for instance, improve the ability to design, manufacture, and/or operate a septum polarizer configured to convert the polarization of signals at more than one carrier signal frequency.

In the illustrated embodiment, the polarizer section 320 includes one or more sidewall features 356. Specifically, as illustrated in the present example, the polarizer section 320 has a first sidewall feature 356-*a*-1, a second sidewall feature 356-*a*-2, and a third sidewall feature 356-*a*-3, each forming a recess in a first sidewall 361-*a* of a first set of opposing sidewalls 130-*a* of the waveguide device 100. A recess in a sidewall may be understood as forming a cavity in the sidewall projecting outwardly (relative to the waveguide volume) from the plane of the sidewall. For example, the sidewall feature 356*a*-1 forms a cavity projecting into the first sidewall 361-*a* in the negative X-direction. The polarizer section also has a third sidewall feature 356-*a*-3, a fourth sidewall feature 356-*a*-4, and a fifth sidewall feature 356-*a*-5, each forming a recess in a second sidewall 362-*a* of the first set of opposing sidewalls 330-*a*. The polarizer section can have sidewall features 356-*a* on both sidewalls of an opposing set of sidewalls, and/or multiple sidewall features 356-*a* on the same sidewall, in some cases.

Each sidewall feature 356-*a* can have a depth in a direction between the first sidewall 361-*a* and the second sidewall 362-*a* of the first set of opposing sidewalls 330-*a*, measured from the plane of the sidewall upon which the sidewall feature is located (e.g., the first sidewall 361-*a* or the second sidewall feature 362-*a* of the first set of opposing sidewalls 330-*a*). Each sidewall feature 356-*a* can have a width in a direction along the central axis of the waveguide device 100. Each sidewall feature 356-*a* can have a length in a direction between a first sidewall 341-*a* and the second sidewall 342-*a* of the second set of opposing sidewalls 340-*a*.

As illustrated in the present example, different sidewall features 356-*a* may have the same dimensions (e.g., sidewall features 356-*a*-1 and 356-*a*-3 may have the same dimensions), and different sidewall features may have different dimensions (e.g., sidewall features 355-*a*-1 and 355-*a*-2 may have different depth and width dimensions). Furthermore, the present example illustrates the sidewall features 356-*a* having a length that is equal to the distance between the first sidewall 341-*a* and the second sidewall 342-*a* of the second set of opposing sidewalls 340-*a*. Said more generally, a sidewall feature 356-*a* may be coincident with both a first sidewall 341-*a* and a second sidewall 342-*a* of the second set of opposing sidewalls 340-*a*. In other examples, a sidewall feature 356-*a* may have a length that is shorter than the distance between the first sidewall 341-*a* and the second sidewall 342-*a* of the second set of opposing sidewalls 340-*a*. Therefore, in some examples a sidewall feature 356-*a* may be coincident with only one sidewall from the second set of sidewalls 340-*a*, or not be coincident with either sidewall of the second set of opposing sidewalls 340-*a*.

In some example of the waveguide device 100, the width of a sidewall feature 356-*a* and/or depth of a sidewall feature 356-*a* may have a particular relationship with a cross-sectional dimension of the polarizer section. For instance, one or more dimensions of a sidewall feature 356-*a* may be significantly smaller than the dimensions of a cavity of the polarizer section 320, and such relationship can provide particular desirable performance characteristics of the waveguide device 100. In some examples, the height or width of a cross-section of the polarizer section 320 can be at least five times greater than at least one of the width or the depth of a sidewall feature 356-*a*. In some examples, the height or width of the cross-section of the polarizer section 320 can be at least ten times greater than at least one of the width or the depth of a sidewall feature 356-*a*.

Although multiple sidewall features 356-*a* are shown in the illustrated example, it should be understood that a single sidewall feature 356-*a* may be formed on one or each of the first sidewall 361-*a* or the second sidewall 362-*a* of the first set of opposing sidewalls 330-*a*. Furthermore, the number of sidewall features 356-*a* on the first sidewall 361-*a* of the first set of opposing sidewalls 330-*a* (e.g., zero, one or more) need not be equal to the number (e.g., zero, one or more) of sidewall features 356-*a* on the second sidewall 362-*a* of the first set of opposing sidewalls 330-*a*, nor do sidewall features 356-*a* need to be the same size or shape.

In the illustrated example, the sidewall features 356-*a* have a square cross-sectional shape. In various other examples, a sidewall feature 356-*a* may have any suitable cross-sectional shape, which may or may not be the same as another sidewall feature 356-*a* of the waveguide device 100.

In the illustrated example, the sidewall features 356-*a* are recesses. In alternative examples, some or all of the sidewall features 356-*a* are protrusions. A protrusion on a sidewall may be understood as a discontinuity of the surface of the sidewall projecting inward (relative to the waveguide volume) form the place of the sidewall.

In some examples, one or more sidewall features 356-*a* can be aligned with one another, where aligned sidewall features 356-*a* are on opposing sidewalls of the first set of opposing sidewalls 330-*a* and have at least one characteristic (e.g., edge, center of the width dimension, etc.) at the same position along the central axis of the waveguide device 100. For example, the first sidewall feature 356-*a*-1 and the fourth sidewall feature 356-*a*-4 can have edges closest to the first common waveguide 331 that are at the same position along the central axis.

In some examples, the waveguide device 100 includes one or more septum features as discussed above with respect to FIG. 3C, and one or more sidewall features as discussed with respect to FIG. 3D.

Figure 3E:
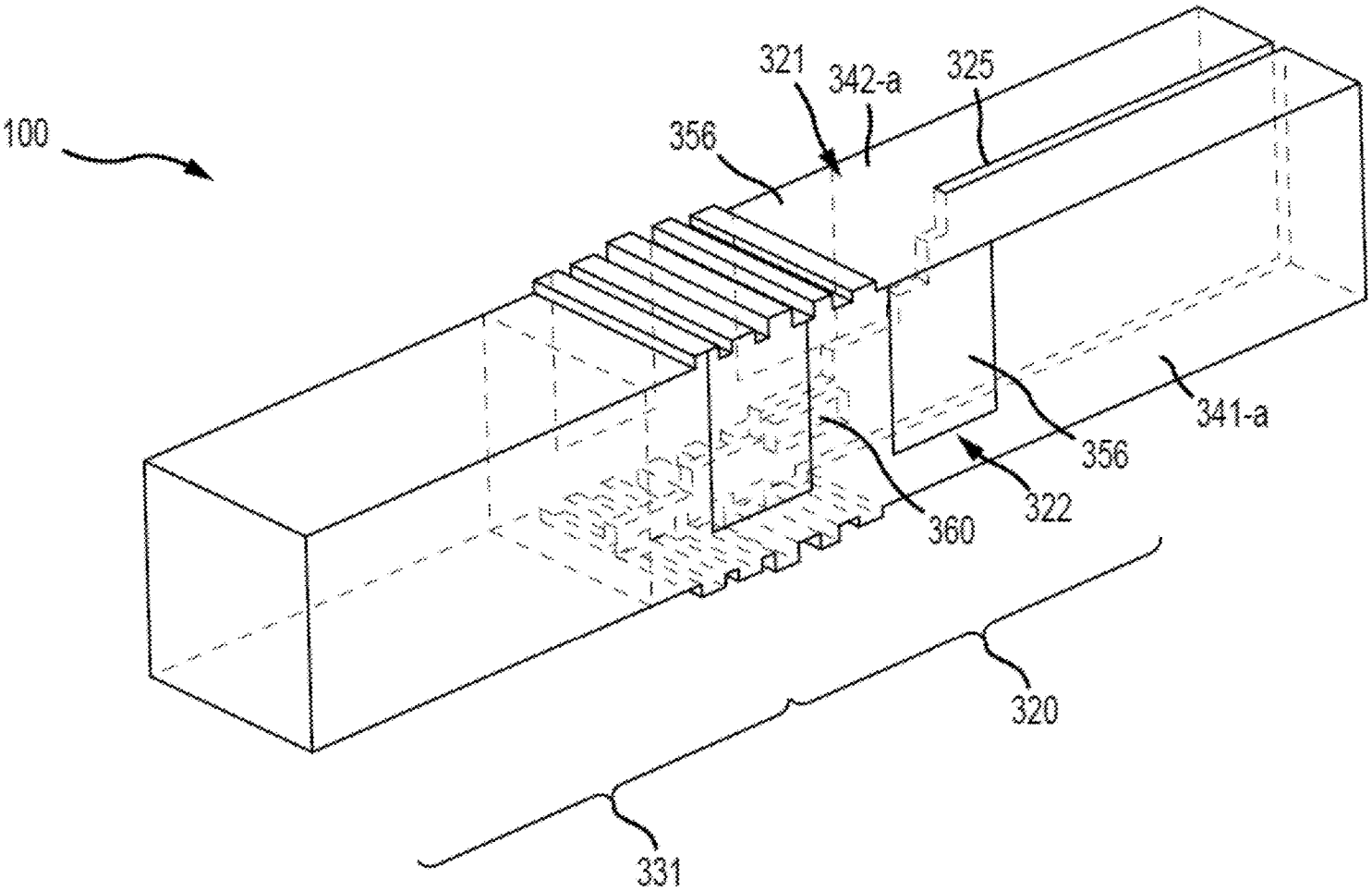
FIG. 3E is a perspective view of a third embodiment of the waveguide device.

FIG. 3E is a perspective view of a fourth embodiment of the waveguide device 100 with sidewall features and a slot coupling hole. The waveguide device 100 is illustrated with the dielectric insert omitted for clarity. In the example of FIG. 3E, the waveguide device 100 includes a slot coupling hole 360 (or other opening) between the individual divided waveguides 321, 322 and extending through the conductive septum 325. The addition of the slot coupling hole 360 can enable higher order mode suppression at higher operational frequencies. In some embodiments, the mode suppression by the slot coupling hole 360 can provide 6 dB or more of higher order mode suppression. As a result, the slot coupling hole 360 can provide improved performance at operational frequencies as compared to the waveguide device of FIGS. 3A-3B. In the example of FIG. 3E, the waveguide device 100 also includes asymmetric sidewall features 356 (in this example rectangular protrusions, alternatively other types and shapes) on the first sidewall 341-*a* and the second sidewall 342-*a* of the second set of opposing sidewalls 340-*a*. The features 356 are asymmetric in the sense that they do not extend all the way between the first set of opposing sidewalls. The asymmetric sidewall features 356 can provide further improvement of on-axis cross-polarization (axial ratio).

Figure 4A:
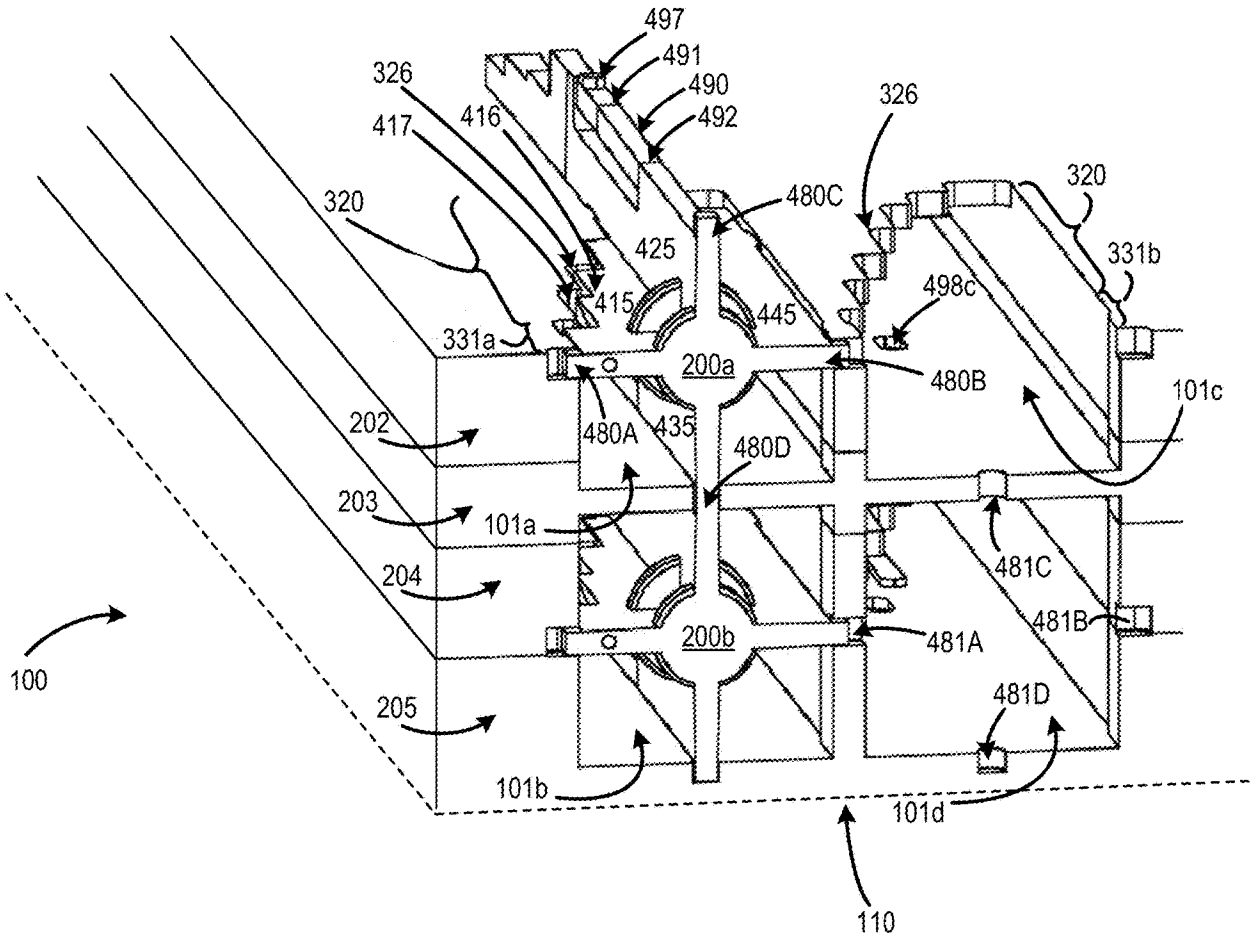
FIG. 4A illustrates another close-up perspective view of the waveguide device with a first layer removed.

FIG. 4A illustrates another close-up perspective view of waveguide device 100 with the first layer removed. In FIG. 4A, dielectric insert 200*a* and the dielectric insert 200*b* are shown "inserted" into radiating element 101*a* and radiating element 101*b*, respectively. The dielectric inserts associated with radiating element 101*c* and radiating element 101*d*, are not shown for clarity. In the illustrated embodiment, a first common waveguide 331*a* (see also 331*b*) is a square waveguide. Alternatively, the first common waveguide 331*a* may be other than square, such as rectangular. In the illustrated embodiment, the dielectric insert 200*a* is inserted into the first common waveguide 331*a*.

In the illustrated embodiment, the dielectric insert 200*a* comprises first dielectric portion that, when fully inserted, corresponds to the polarizer section 320 of waveguide device 100. Thus, the first dielectric portion of dielectric insert 200*a* may partially fill the polarizer section 320 of radiating element 101*a*. The first dielectric portion may include at least a portion of a first dielectric fin 415 (described below). In the illustrated embodiment, the dielectric insert 200*a* comprises a second dielectric portion that, when fully inserted, corresponds to the first common waveguide 331 of waveguide device 100. Thus, the second dielectric portion of dielectric insert 200*a* may partially fill the first common waveguide 331. In the illustrated embodiment, at least a section of the second dielectric portion has a cruciform cross-section (as described below). In the illustrated embodiment, the dielectric insert 200*a* comprises a third dielectric portion that provides transitioning between the second waveguide 332 (not shown) and the polarizer section 320, and a fourth dielectric portion that provides transitioning between the third waveguide 333 (not shown) and the polarizer section 320.

The dielectric insert 200*a* comprises a first dielectric fin 415. In the illustrated embodiment, the first dielectric fin 415 has a shaped edge 416. In the illustrated embodiment, the shaped edge 416 of the first dielectric fin 415 comprises a plurality of steps, such as six steps. Moreover, the shaped edge 416 can have any suitable number of steps. In an alternative embodiment, the shaped edge 416 can have any other suitable shape, such as smooth.

In the illustrated embodiment, the first dielectric fin 415 has a shaped edge 416 corresponding to the shaped edge 326 of conductive septum 325. The shaped edge 416 of the first dielectric fin 415 and the shaped edge 326 of the conductive septum 325 are separated by a gap 417. The gap 417 between the shaped edge 326 and the shaped edge 416 can have a width that is different at various positions along the gap 417. Thus, the width of the gap 417 can vary along the shaped edges of the first dielectric fin 415 and the conductive septum 325. The width of the gap 417 and how it varies along the shaped edges can vary from embodiment to embodiment. In some embodiments, at least a portion of the width of the gap 417 is substantially zero, where substantially is intended to accommodate manufacturing tolerances and coefficient of thermal expansion (CTE) mismatch.

Thus, the shape of the shaped edge 326 and shaped edge 416 can be any shape (stepped, shaped, spline, tapered, and the like) that is suitable for facilitating transitioning of the first common waveguide 331 to the second waveguide 332 and third waveguide 333. In the stepped embodiment, the steps of shaped edge 326 can overlap the steps of shaped edge 416. In this embodiment, the steps of shaped edge 416 of the dielectric insert 200*a* may not completely match the steps of the shaped edge 326 of the conductive septum 325. Alternatively, the number of steps of the shaped edge 326 can vary from the number of steps of the shaped edge 416. Alternatively, the length of the steps of the shaped edge 326 can vary from the length of the steps of the shaped edge 416. The variation between the steps of the shaped edge 326 and the steps of the shaped edge 416 can be useful, as it can facilitate additional degrees of freedom to work with in designing the antenna system 170. Stated another way, partially dielectrically loading the polarizer section 320 and other sections of the radiating elements 101 can give designers an additional degree of freedom to achieve desired antenna performance characteristics.

In the illustrated embodiment, dielectric insert 200*a* further comprises a second dielectric fin 425. The second dielectric fin 425 may further be connected to the second end 492 of a flexible finger 490. The second dielectric fin 425 further comprises a retention tab 480C (discussed below).

In the illustrated embodiment, dielectric insert 200*a* further comprises a third dielectric fin 435. The third dielectric fin 435 may be a substantially planar structure, coplanar with the second dielectric fin 425. The third dielectric fin 435 comprises a alignment tab 480D (discussed below).

In the illustrated embodiment, dielectric insert 200*a* further comprises a fourth dielectric fin 445. The fourth dielectric fin 445 may be a substantially planar structure, coplanar with the first dielectric fin 415. The fourth dielectric fin 445 comprises the retention tab 480B (discussed below).

In the illustrated embodiment, dielectric insert 200*a* comprises a cruciform cross-section near the aperture end of the dielectric insert 200*a*. The cruciform cross-section is formed by the orthogonal intersection of the first dielectric fin 415 and the fourth dielectric fin 445 with the second dielectric fin 425 and the third dielectric fin 435 (or the orthogonal intersection of their corresponding planes).

Thus, the cruciform cross section of the dielectric insert 200 facilitates inhomogeneous dielectric loading. In the illustrated embodiment, the dielectric insert 200*a* cruciform cross-section is orthogonal (or approximately orthogonal) to the walls of the first common waveguide 331 (as opposed to at 45 degree angles, or other such angle, to those walls). By "approximately orthogonal" it is meant that the orthogonality is within 0-5 degrees of orthogonal. The cruciform cross section of dielectric insert 200*a* may facilitate making the first common waveguide 331 (and the antenna array) smaller, propagating lower frequencies well, and working in concert with the metal steps of the conductive septum to provide the polarizer functionality.

In the illustrated embodiment, the dielectric insert 200*a* comprises a member having a length that is substantially greater than its maximum height, and a thickness of an individual piece that is substantially smaller than its height. The thickness can be a function of the desired waveguide loading effect and can depend on the material dielectric constant value and the spacing between adjacent radiating elements 101*a*, 101*b*, 101*c*, and 101*d*. The dielectric loading effect needed can also depend on the lowest frequency of operation in relation to the antenna element spacing. In the illustrated embodiment, the dielectric insert 200*a* has a height (in the direction of 425 and 435) that is as tall as the first common waveguide 331 at the aperture end of the dielectric insert 200. In the illustrated embodiment, the dielectric insert 200*a* also has a width (in the direction of 415 and 445) that is the full width of the first common waveguide 331 at the aperture end of the dielectric insert 200. Moreover, the dielectric insert 200*a* width can narrow down in the direction away from the aperture.

Retention/Alignment Features

In FIG. 4A the waveguide device 100 is illustrated with a first layer removed, and illustrates various alignment and retention features. In the illustrated embodiment, dielectric insert 200*a* further comprises a first retention feature or alignment feature, and the waveguide device 100 includes a second retention feature or alignment feature corresponding to the first retention/alignment feature. In the illustrated embodiment, the first alignment feature is an alignment tab 480A, and the second alignment feature is an alignment hole 481A to engage the alignment tab 480A. The alignment hole 481A comprises a notch or groove in the face of the antenna aperture 110 at the opening of, and at the edge of, the first common waveguide 331. For readability, the alignment holes (481A-481D) are shown in radiating element 101*d*, but it is intended to illustrate where these alignment tabs would be for radiating element 101*a*. The alignment hole 481A and alignment tab 480A are configured to have dimensions such that when fully inserted, the alignment hole 481A and alignment tab 480A fit together in a corresponding way to facilitate alignment of the dielectric insert 200 within the first common waveguide 331 and to define a depth of penetration of dielectric insert 200*a* in radiating element 101*a*. In the illustrated embodiment, an alignment hole 481A is used on all four sides of the first common waveguide 331 (e.g., 481A, 481B, 481C, and 481D), and the dielectric insert 200 comprises respective alignment tabs (480A, 480B, 480C, and 480D). In an alternative embodiment, not shown, any suitable number of alignment tabs 480A and corresponding alignment holes 481A can be used to facilitate alignment of the dielectric insert 200*a* within first common waveguide 331.

Thus, in the illustrated embodiment, waveguide device 100 comprises an alignment keyway (not shown) and an anti-rotation keyway. The anti-rotation keyways are the alignment holes 481A-D. Moreover, the alignment holes 481A-D are designed to prevent the dielectric insert from being inserted too far.

In the illustrated embodiment, the dielectric insert 200*a* includes a first retention feature such as a retention tab 497. For example, the dielectric insert 200*a* may comprise a flexible finger 490. Flexible finger 490 comprises a first end 491 and a second end 492. The flexible finger 490 is connected to at least one other portion of the dielectric insert 200*a* at the second end 492. In this illustrated embodiment, a retention tab 497 is located at the first end 491 of the flexible finger 490. In this embodiment, waveguide device 100 further comprises a second retention feature, such as a retention hole. The retention hole (not shown, but see similar retention hole 498*c* in radiating element 101*c*), may be configured to receive/engage the retention tab 497. In an additional embodiment, the retention tab 497 and the retention hole 498 are configured to engage to retain dielectric insert 200*a* in place within waveguide device 100. More generally, any suitable configuration may be used to retain the dielectric insert 200 within waveguide device 100. In some embodiments, the dielectric insert 200 can be removably retained within waveguide device 100. In other embodiments, the dielectric insert 200*a* is intended to snap in place as a permanent attachment.

Figure 4B:
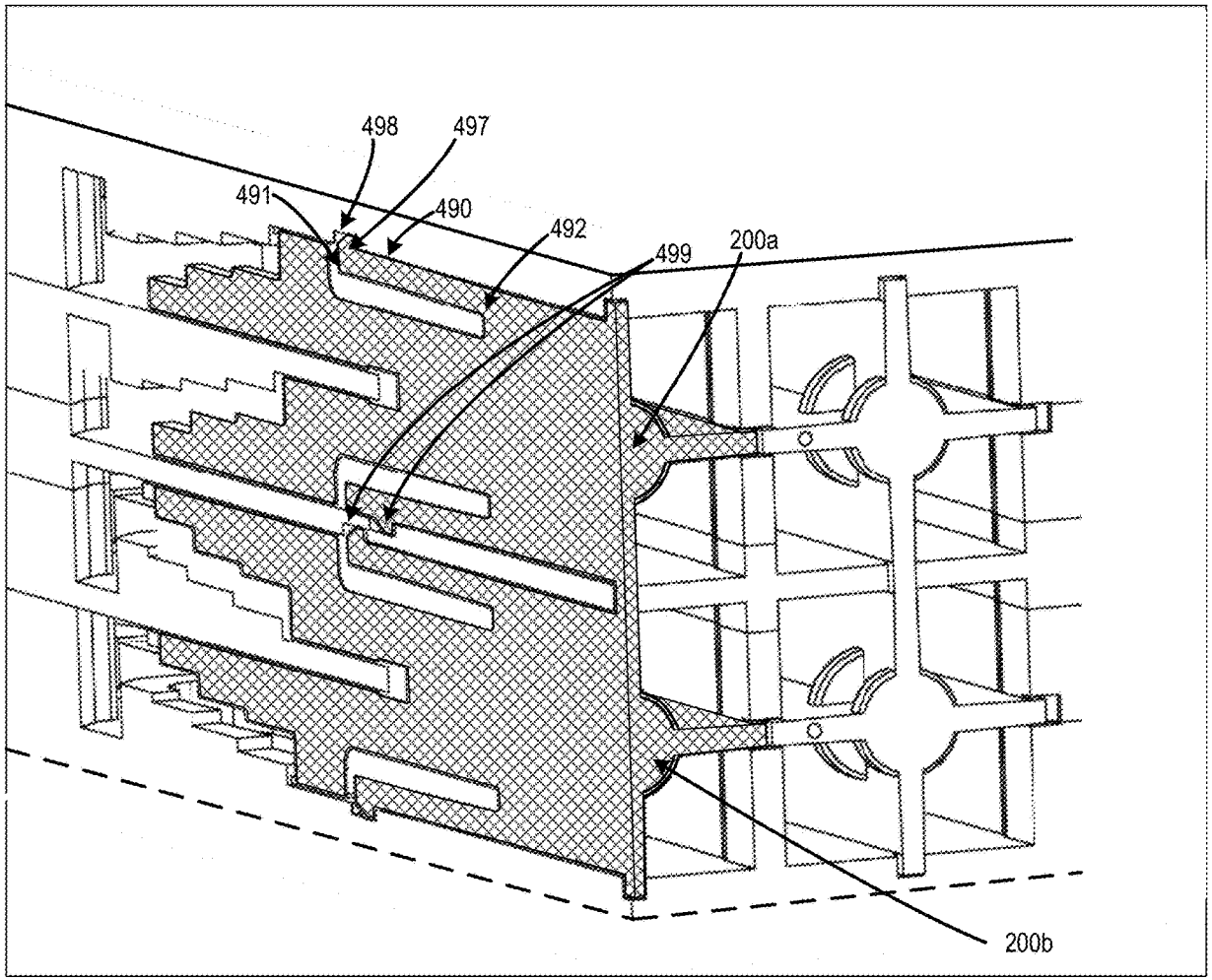
FIG. 4B is a perspective cut-away view of a portion of the waveguide device.

FIG. 4B illustrates a perspective cut-away view of a portion of the waveguide device 100. The dielectric insert 200*a* and dielectric insert 200*b* are illustrated "in place" or "inserted" in waveguide device 100. In this view, the engagement of retention tab 497 and retention hole 498 can be more easily seen. It can be noted (see 499) that the retention hole 498 (for the top and the bottom of radiating element 101*a*) and corresponding retention tab 497 (for the top and bottom of the dielectric insert 200*a*) can be staggered for each flexible finger 490, such that these retention mechanisms do not interfere with each other. In addition, the shape of the flexible finger 490 can be molded to provide any suitable preload in the installed position.

Figure 5:
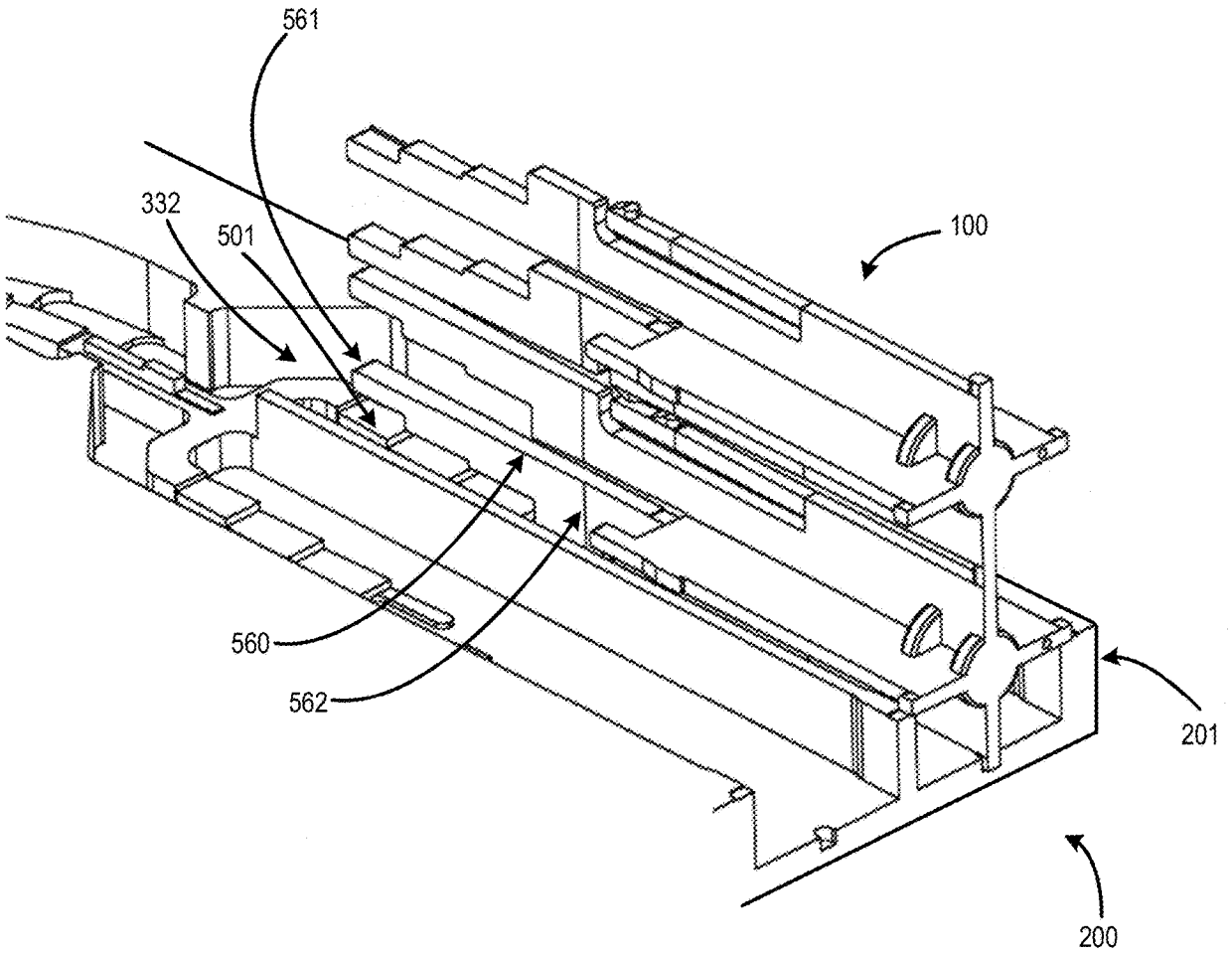
FIG. 5 is a perspective view of the bottom of the first layer of a portion of the waveguide device.

FIG. 5 is a perspective view of the bottom of the first layer 201 of the waveguide device 100. In the illustrated embodiment, first layer 201 comprises a first ridge 501 located in the second waveguide 332. Thus, second waveguide 332 is a ridge loaded waveguide. In some embodiments, the first ridge 501 is omitted, such that the second waveguide 332 is not ridge-loaded. In the illustrated embodiment, the first ridge 501 has a rectangular cross-section, is located in the center of the waveguide, and extends into the second waveguide 332 from the ceiling of first layer 201. The first ridge 501 is configured to transition from a non-ridge, partially dielectric loaded waveguide to a ridge loaded waveguide. The first ridge 501 comprises any suitable number of steps, rising in height in the direction away from the antenna aperture 110. In an alternative embodiment, the first ridge 501 is a shaped ridge with a curved, spline, or other suitable shape. Moreover, the first ridge 501 may comprise any form factor suitable for transitioning between the second waveguide 332 and the polarizer section 320.

In the illustrated embodiment, the dielectric insert 200 further comprises a first transition portion 560. The first transition portion 560 has a first distal end 561 and first proximal end 562. The first transition portion 560 is coupled to the rest of the dielectric insert 200 at the first proximal end 562. In this embodiment, the first transition portion 560 comprises steps reducing the height of the first transition portion 560 in the direction going from first proximal end 562 to first distal end 561. The first transition portion 560 can comprise any suitable number of steps. In an alternative embodiment, the first transition portion 560 is a shaped member with a curved, spline, or other suitable shape. Moreover, the first transition portion 560 may comprise any form factor suitable for transitioning between the second waveguide 332 and the polarizer section 320. In the illustrated embodiment, the first transition portion 560 roughly corresponds (quasi complementary) to the first ridge 501. Stated another way, a gap between the first ridge 501 and the first transition portion 560 may vary along the length of the gap between the two objects. Here again, the size of the gap between the first ridge 501 and the first transition portion 560, as well as the shape of these two elements, provides added degrees of freedom in design of waveguide device 100. Also, the first transition portion 560 partially dielectrically loads the second waveguide 332.

Figure 6:
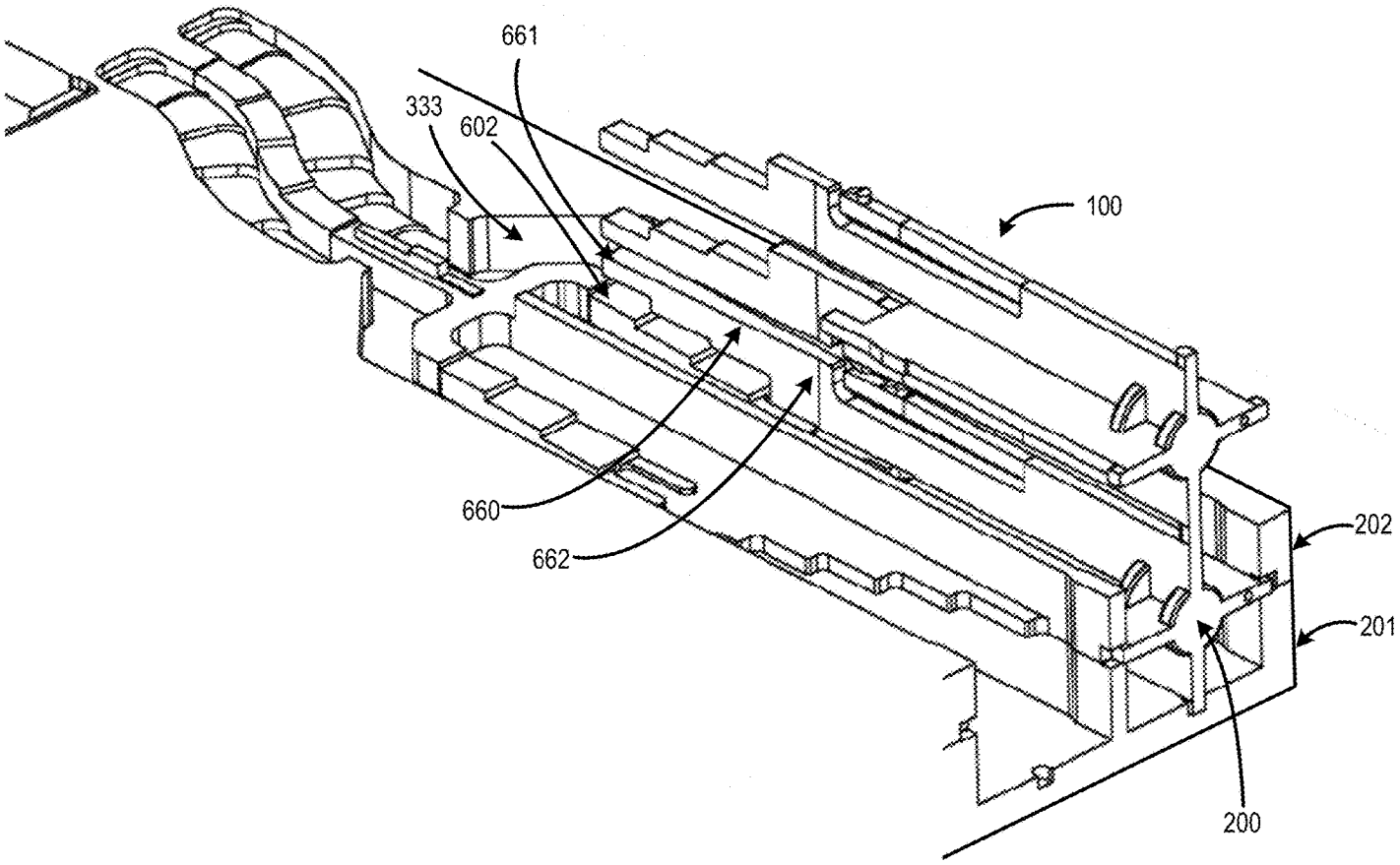
FIG. 6 is a perspective view of the bottom of the second layer of a portion of the waveguide device.

FIG. 6 is a perspective view of the bottom of the second layer 202 of a portion of the waveguide device 100. In the illustrated embodiment, second layer 202 comprises a second ridge 602 located in third waveguide 333. Thus, third waveguide 333 is a ridge loaded waveguide. Similar to the discussion above, in some embodiments, the second ridge 602 is omitted, such that the third waveguide 333 is not ridge-loaded. In the illustrated embodiment, the second ridge 602 has a rectangular cross-section, is located in the center of the waveguide, and extends into the third waveguide 333 from the ceiling of second layer 202. The second ridge 602 is configured to transition from a non-ridge loaded waveguide to a ridge loaded waveguide. The second ridge 602 comprises any suitable number of steps, rising in height in the direction away from the antenna aperture 110. In an alternative embodiment, the second ridge 602 is a shaped ridge with a curved, spline, or other suitable shape. Moreover, the second ridge 602 may comprise any form factor suitable for transitioning between the third waveguide 333 and the polarizer section 320.

In the illustrated embodiment, the dielectric insert 200 further comprises a second transition portion 660. The second transition portion 660 has a second distal end 661 and second proximal end 662. The second transition portion 660 is coupled to the rest of the dielectric insert 200 at the second proximal end 662. In this embodiment, the second transition portion 660 comprises steps reducing the height of the second transition portion 660 in the direction going from second proximal end 662 to second distal end 661. The second transition portion 660 can comprise any suitable number of steps. In an alternative embodiment, the second transition portion 660 is a shaped member with a curved, spline, or other suitable shape. Moreover, the second transition portion 660 may comprise any form factor suitable for transition between the third waveguide 333 and the polarizer section 320. In the illustrated embodiment, the second transition portion 660 roughly corresponds (quasi complementary) to the second ridge 602. Stated another way, a gap between the second ridge 602 and the second transition portion 660 may vary along the length of the gap between the two objects. Here again, the size of the gap between the second ridge 602 and the second transition portion 660, as well as the shape of these two elements, provides added degrees of freedom in design of waveguide device 100. Also, the second transition portion 660 partially dielectrically loads the third waveguide 333.

Figure 7:
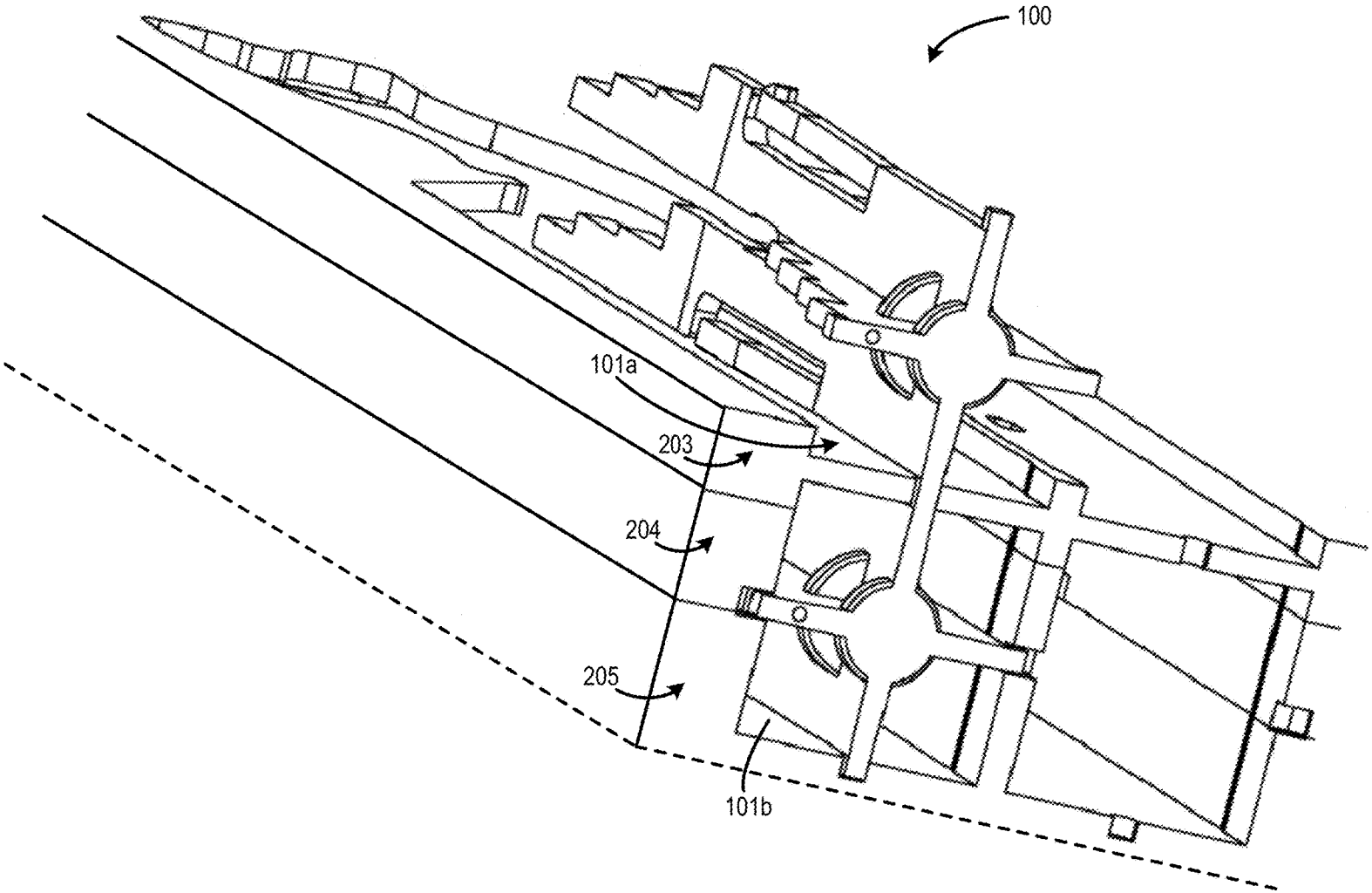
FIG. 7 is a perspective view of a portion of the waveguide device with the first and second layers removed.

FIG. 7 is a perspective view of the waveguide device 100 with the first layer 201 and second layer 202 removed. Third layer 203, in the illustrated embodiment separates radiating element 101*a* from radiating element 101*b*.

Figure 8:
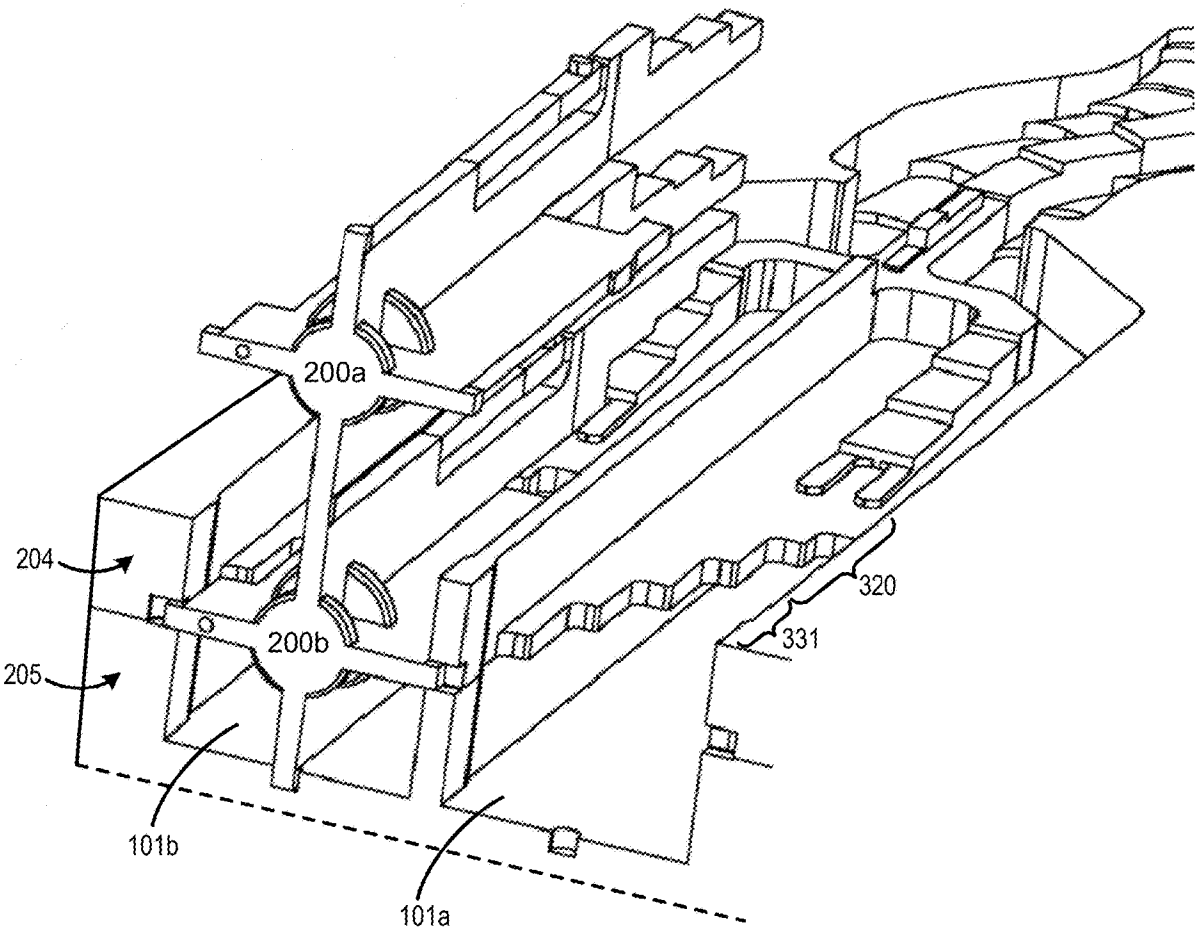
FIG. 8 is a perspective view of a portion of the waveguide device with the first, second, and third layers removed.

FIG. 8 is a perspective view of a portion of the waveguide device 100 with the first layer 201, second layer 202, and third layer 203 removed. In the illustrated embodiment, the fourth layer 204 is similar to the second layer 202, but inverted, with the stepped ridge-loaded waveguide located on the floor of the waveguide in the fourth layer 204, as opposed to on the ceiling of the waveguide in the second layer 202. This difference is also reflected in the inversion of the dielectric insert as between dielectric insert 200*a* and dielectric insert 200*b*.

In the illustrated embodiment, the waveguide device 100 comprises symmetry in the arrangement of the individual radiating elements 101*a*-101*d*. For example, in one radiating element, the dielectric insert is inserted inverted (180 degrees) from the orientation of insertion in an adjacent radiating element. This means that the internal arrangement of the waveguides in waveguide device 100 is also inverted to correspond to the inverted dielectric insert. Thus, in additional embodiments, every other septum polarizer is inverted. However, in alternative embodiments every other pair of septum polarizers is inverted. Moreover, in other alternative embodiments, all of the septum polarizers are oriented in the same orientation. Similarly, in various alternative embodiments, the orientation of the dielectric inserts corresponds to the orientation of the respective septum polarizers. The inverting of the dielectric inserts facilitates a reduction in the mutual coupling of the individual radiating elements 101.

Figure 9:
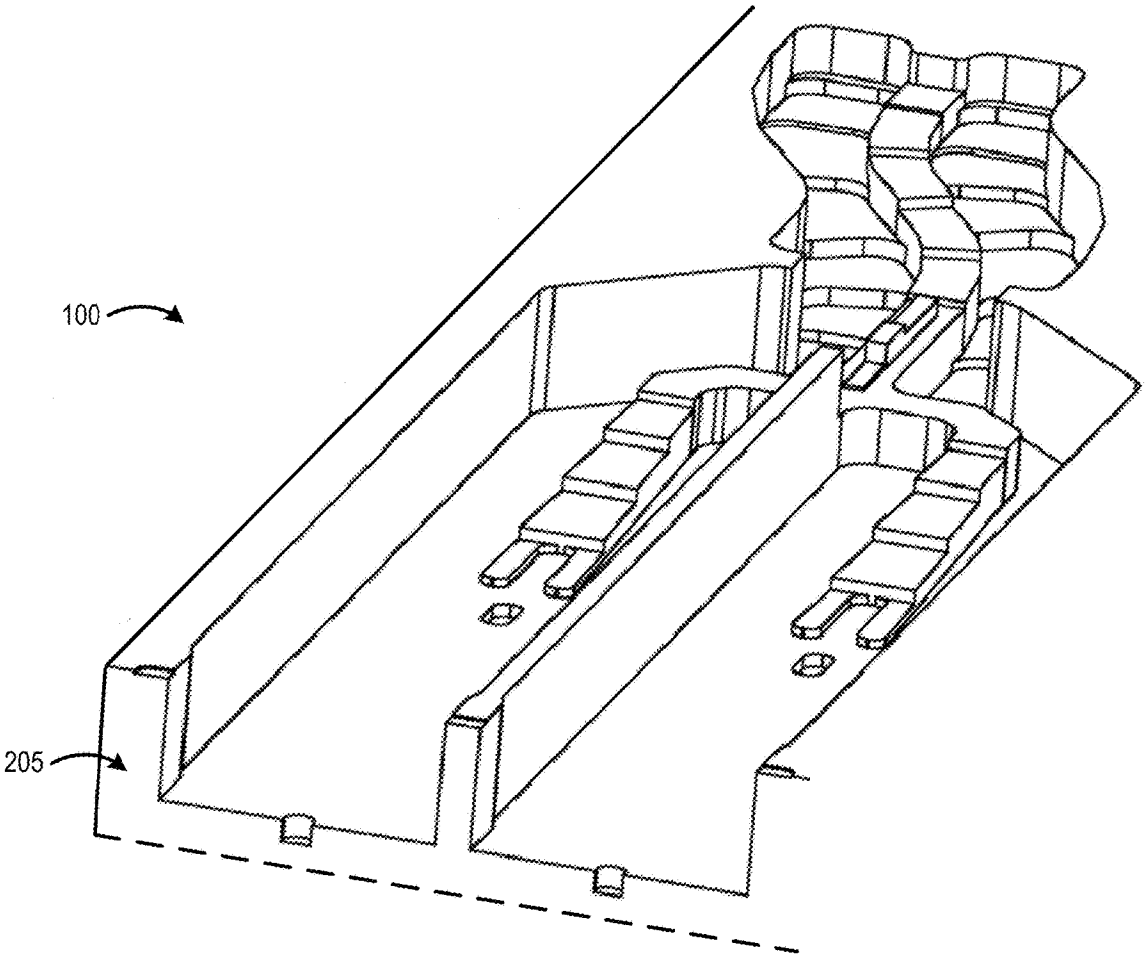
FIG. 9 is a perspective view of a portion of the waveguide device having only the fifth layer (bottom layer) showing.

FIG. 9 is a perspective view of a portion of the waveguide device 100 having only the fifth layer 205 (bottom layer) showing. In the illustrated embodiment, the fifth layer 205 is similar, but inverted, to the first layer 201.

Pucks

Figure 10A:
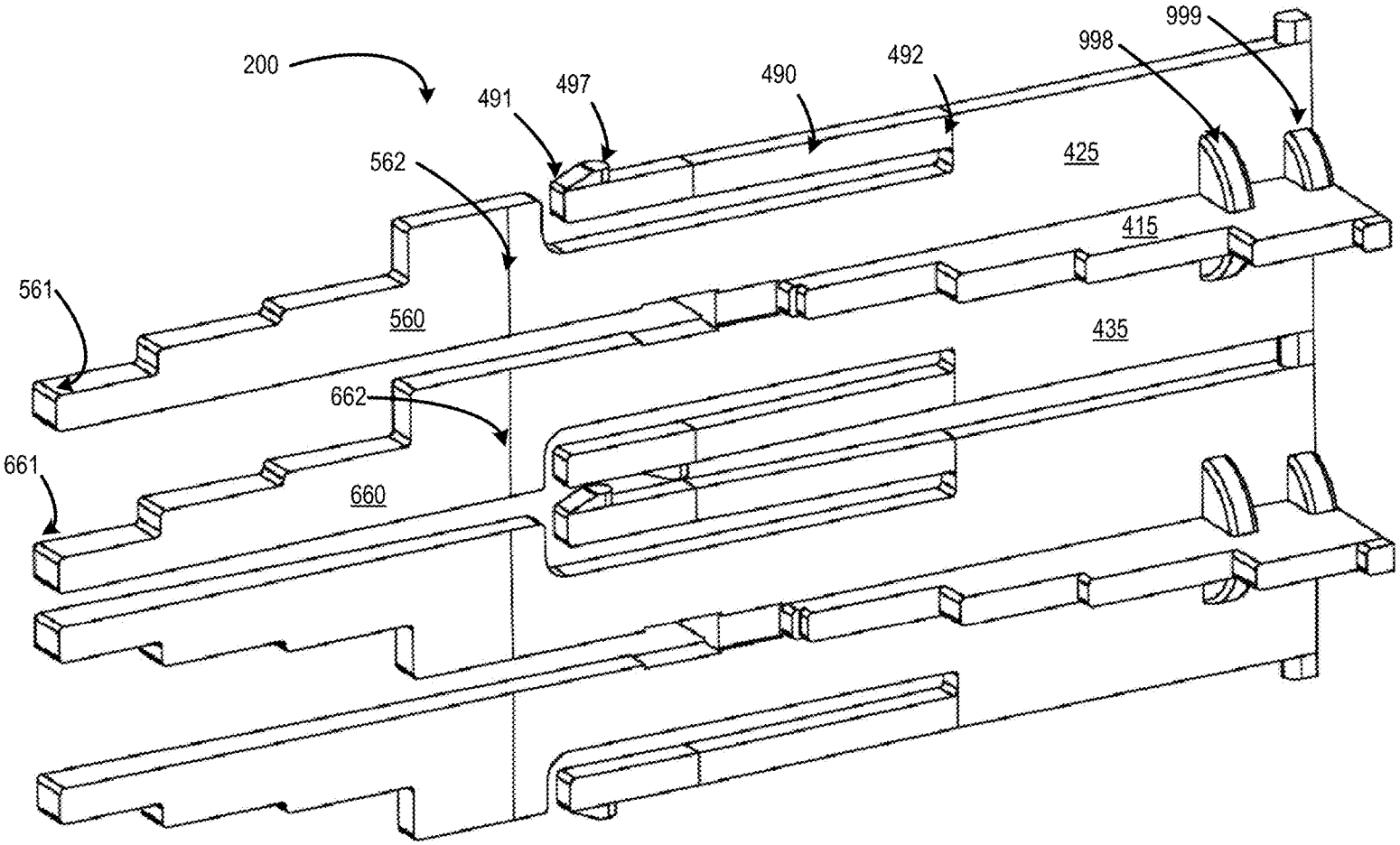
FIGS. 10A and 10B are perspective views of the dielectric insert.

FIG. 10A is a perspective view of a dielectric insert 200. The dielectric insert 200, of FIG. 10A is illustrated as coupled to a second dielectric insert as described above. In the illustrated embodiment, various components and their arrangement can be better seen. For example, first dielectric fin 415 and second dielectric fin 425 are more easily visible in this view. In the illustrated embodiment, the dielectric insert 200 further comprises at least one circular transition feature 998. The circular transition feature 998 is oriented parallel to the aperture plane of waveguide device 100, or perpendicular to the planar dielectric portions of the dielectric insert 200. The dielectric insert 200 further comprises a second circular transition feature 999. Moreover, dielectric insert 200 can comprise any suitable transition features for transitioning with free space.

Figure 10B:
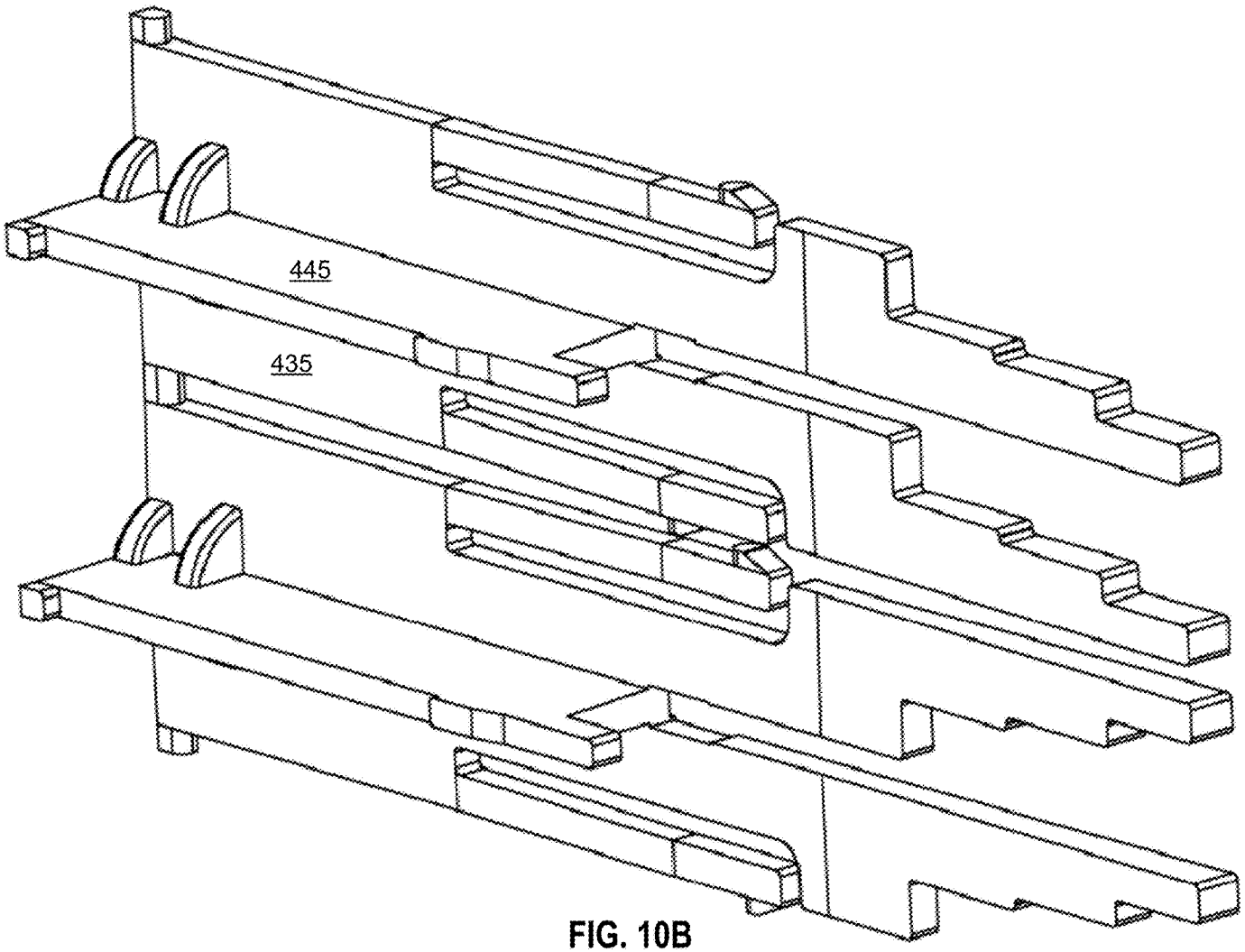

FIG. 10B is another perspective view of a dielectric insert 200. In the illustrated embodiment, various components and their arrangement can be better seen. For example, third dielectric fin 435 and fourth dielectric fin 445 are more easily visible in this view.

Rotatable Coupling

Figure 11A:
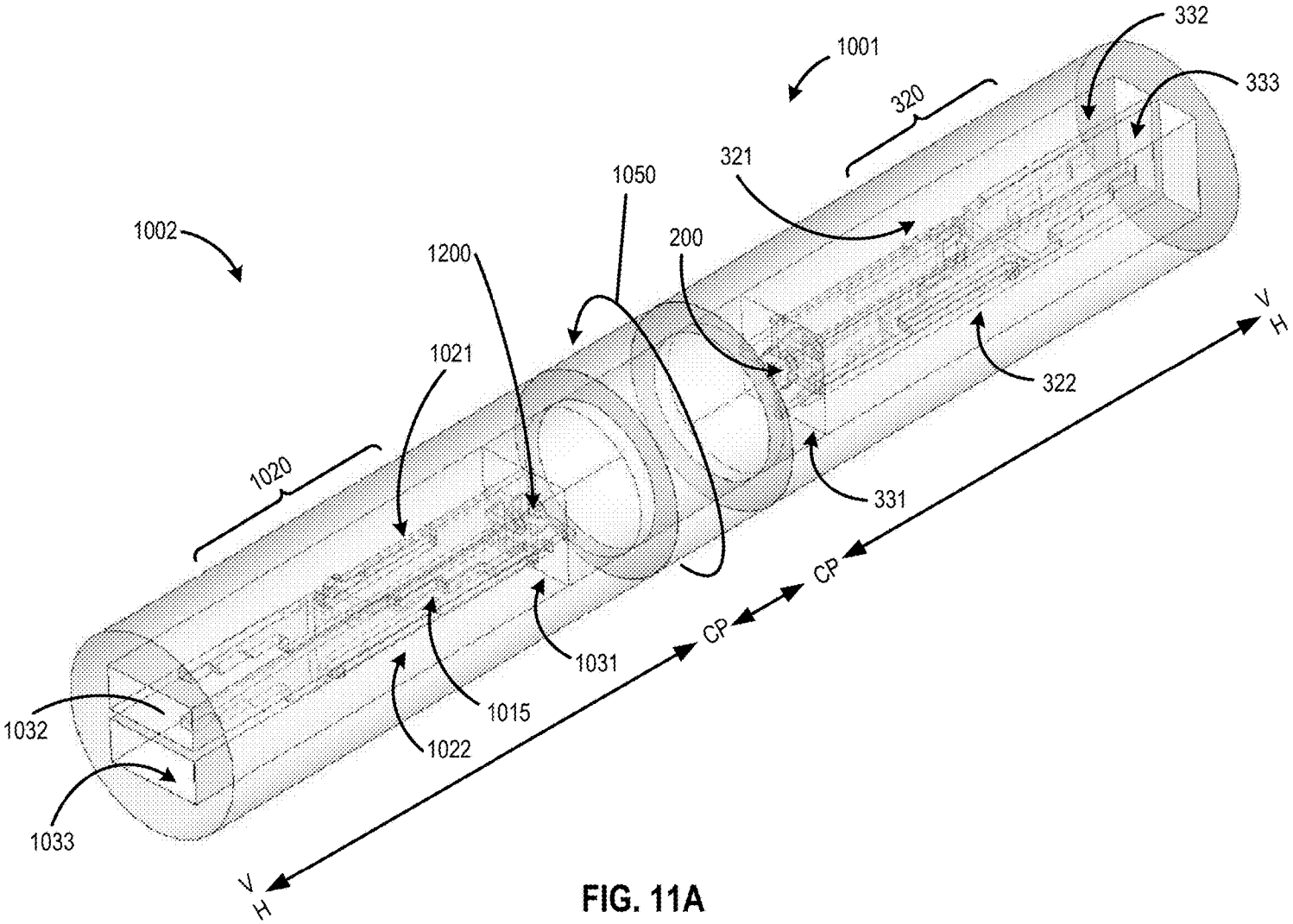
FIGS. 11A and 11B are perspective views and cut-away views of back-to-back waveguide devices.
Figure 11B:
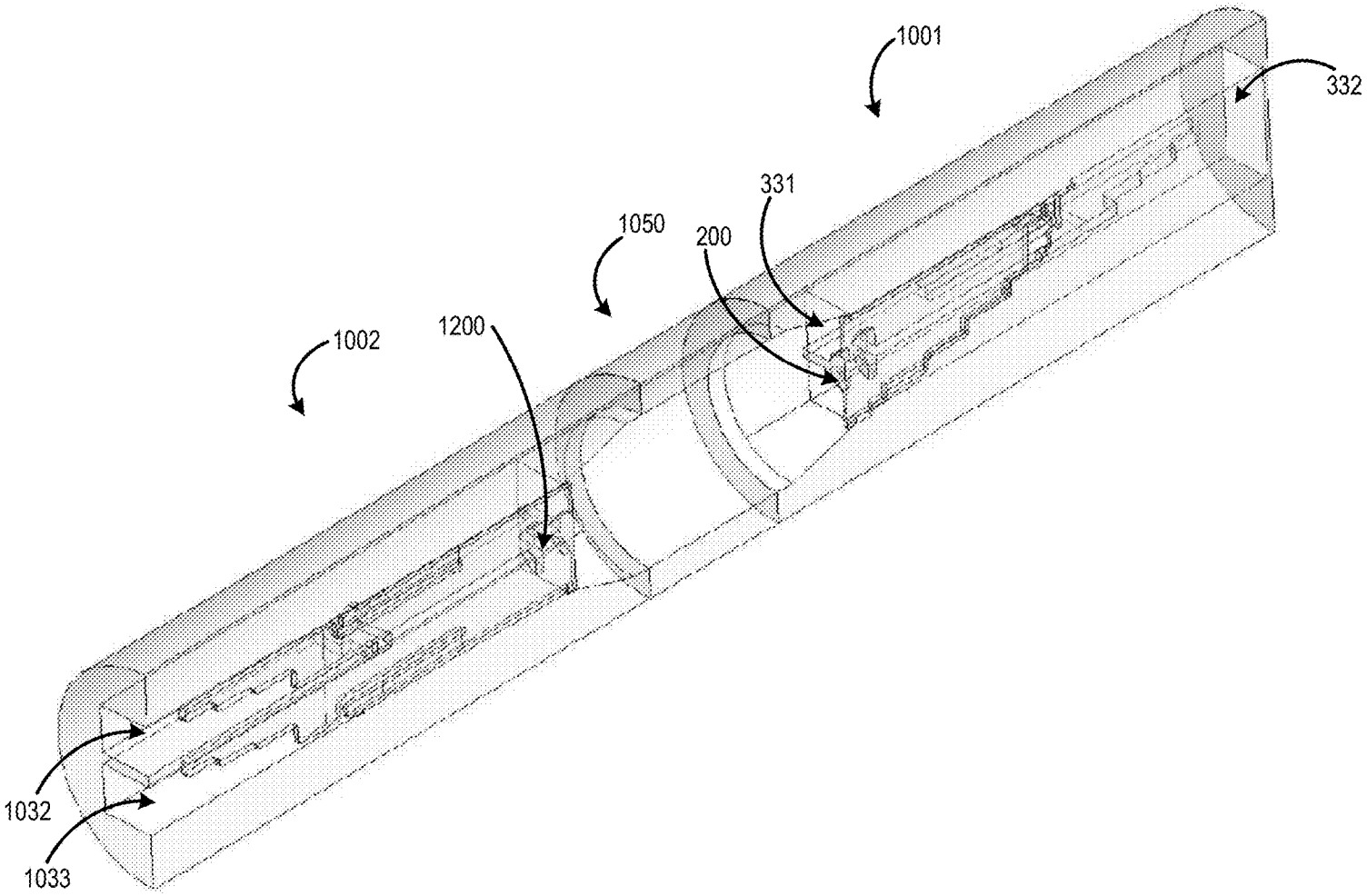

FIG. 11A is a perspective view of a waveguide device including back-to-back partial dielectric loaded septum polarizers. FIG. 11A illustrates a rotatable coupling in accordance with various aspects disclosed herein. FIG. 11B is a cut-away view of FIG. 11A. In the illustrated embodiment, a first waveguide device 1001 and second waveguide device 1002 (each similar to waveguide device 100) are coupled to each other. In the illustrated embodiment, the coupling is a rotary coupling 1050. In some embodiments, the rotary coupling 1050 is a dual-channel RF rotary joint. Alternatively, other mechanisms may be used for the rotary coupling 1050. The first waveguide device 1001 comprises the first common waveguide 331 and other components of waveguide device 100 as described herein. The second waveguide device 1002 is similarly constructed, comprising a fourth common waveguide 1031 (similar to the first common waveguide 331), a second polarizer section 1020 (similar to the polarizer section 320), coupled to the fourth common waveguide 1031, a fifth waveguide 1032 (similar to the second waveguide 332), and a sixth waveguide 1033 (similar to the third waveguide 333). The second polarizer section 1020 includes a second conductive septum 1025 (similar to conductive septum 325) dividing the fourth common waveguide 1031 into a third divided waveguide portion 1021 (similar to the first divided waveguide portion 321) and a fourth divided waveguide portion 1022 (similar to the second divided waveguide portion 322). The fifth waveguide 1032 is coupled to the third divided waveguide portion 1021 of the second polarizer section 1020. Similarly, the sixth waveguide 1033 is coupled to the fourth divided waveguide portion 1022 of the second polarizer section 1020.

The second waveguide device 1002 further comprises a second dielectric insert 1200 (similar to dielectric insert 200), the second dielectric insert 1200 similarly comprising a second dielectric portion partially filling the second polarizer section 1020. In this embodiment, the second conductive septum 1025 and the second dielectric portion convert the signal between dual circular polarization states in the fourth common waveguide 1031 and a first polarization component in the fifth waveguide 1032 and a second polarization component in the sixth waveguide 1033. In this embodiment, the fourth common waveguide 1031 is coupled to the first common waveguide 331. In the illustrated embodiment, the fourth common waveguide 1031 is coupled to the first common waveguide 331 via a rotary coupling 1050. However, in other embodiments, the coupling can be fixed or rotatable. An example fixed coupling is a "dual-channel step twist," where the input and output divided waveguides are oriented at an offset angle such as 90 degrees. The back-to-back waveguide devices (1000/1001) can facilitate maintaining horizontal and vertical polarization signal paths through a rotating junction, such as where slip-rings and the like may be employed. Moreover, this back-to-back system can facilitate connecting waveguide systems located on two planes that are not aligned to each other.

Method

Figure 12:
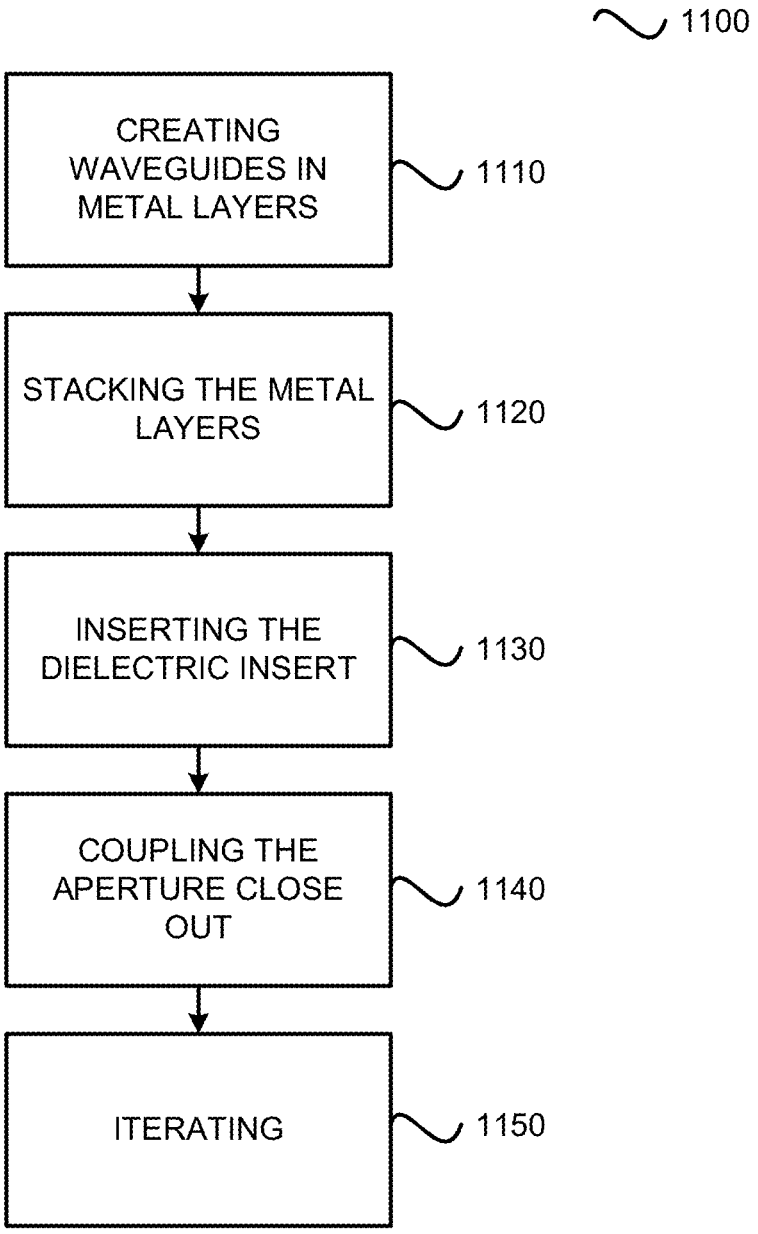
FIG. 12 is a block diagram of an example method for constructing a waveguide device.

FIG. 12 is a block diagram of an example method for constructing a waveguide device 100. A method 1100 of forming a waveguide device 100 comprises: creating waveguides or portions thereof in metal layers (1110), stacking the metal layers to form the azimuth and elevation combiner/divider structure 260 and beamforming network (1120), inserting a dielectric insert 200 into the waveguide element (1130), and coupling the aperture close-out 230 to the azimuth and elevation combiner/divider structure 260 (1140). Method 1100 further comprises iteratively adjusting, during the design stage, the waveguide cross-section, the septum step sizes, the dielectric thickness and the gap sizes (1150). In addition, matching to free-space is optimized by primarily adjusting the circular transition features 998 and 999, i.e. diameter, thickness and location. The matching sections 560/660 are optimized by adjusting the length and height of both metal and dielectric ridge steps.

The waveguide device 100 may for example be designed using High Frequency Structure Simulator (HFSS) available from Ansys Inc. Alternatively, other software may be used to design the waveguide device 100. Method 1100 may be performed on a computer using such computer software to implement various parts of method 1100. The computer may comprise a processor for processing digital data, a tangible, non-transitory memory coupled to the processor for storing digital data, an input device for inputting digital data, an application program stored in the memory and accessible by the processor for directing processing of digital data by the processor, a display device coupled to the processor and memory for displaying information derived from digital data processed by the processor, and one or more databases. The tangible, non-transitory memory may contain logic to allow the processor to perform the steps of method 1100 to model the conductive septum 325 and dielectric insert 200 and to provide parameter optimization capabilities.

In one example embodiment, waveguide device 100 is formed in a metal substrate. The metal substrate can be made of aluminum, copper, brass, zinc, steel, or other suitable electrically conducting material. The metal substrate can be processed to remove portions of the metal material by using: machining and/or probe electrical discharge machining (EDM). Alterative process for forming the structures can be electroforming, casting, or molding. Furthermore, the substrate can be made of a dielectric or composite dielectric material that can be machined or molded and plated with a conducting layer of thickness of at least approximately three skin depths at the operation frequency band.

In an example embodiment, after removing the metal material to form the waveguide pathways, a first cover (or layer) is attached over a first side of the metal substrate, and a second cover (or layer) is attached over the second side of the metal substrate to enclose portions of the waveguides. The covers (or layers) can enclose and thus form rectangular waveguide pathways. The covers (or layers) can comprise aluminum, copper, brass, zinc, steel, and/or any suitable metal material. The covers (or layers) can be secured using screws or any suitable method of attachment. Furthermore, the cover (or layers) can be made of a dielectric or composite dielectric material that can be machined, extruded or molded and plated with a conducting layer of thickness of at least approximately three skin depths at the operation frequency band. The waveguides may be formed using subtractive manufacturing techniques from bulk material such as aluminum sheet. Alternatively, additive manufacturing or a hybrid technique of both additive and subtractive manufacturing may be used. Laser sintering is one example of additive manufacturing. Molding techniques may also be used.

In describing the present disclosure, the following terminology will be used: The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described.

A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

It should be appreciated that the particular implementations shown and described herein are illustrative and are not intended to otherwise limit the scope of the present disclosure in any way. Furthermore, the connecting lines shown in the various figures contained herein are intended to represent exemplary functional relationships and/or physical couplings between the various elements. It should be noted that many alternative or additional functional relationships or physical connections may be present in a practical device.

It should be understood, however, that the detailed description and specific examples, while indicating exemplary embodiments of the present invention, are given for purposes of illustration only and not of limitation. Many changes and modifications within the scope of the instant invention may be made without departing from the spirit thereof, and the invention includes all such modifications. The corresponding structures, materials, acts, and equivalents of all elements in the claims below are intended to include any structure, material, or acts for performing the functions in combination with other claimed elements as specifically claimed. The scope of the invention should be determined by the appended claims and their legal equivalents, rather than by the examples given above. For example, the operations recited in any method claims may be executed in any order and are not limited to the order presented in the claims. Moreover, no element is essential to the practice of the invention unless specifically described herein as "critical" or "essential."

What is claimed is:

1. A waveguide device comprising:

a first common waveguide;

a polarizer section, the polarizer section including a conductive septum dividing the first common waveguide into a first divided waveguide portion and a second divided waveguide portion, and further including a slot coupling hole within the conductive septum and extending between the first and second divided waveguide portions;

a second waveguide coupled to the first divided waveguide portion of the polarizer section; and a third waveguide coupled to the second divided waveguide portion of the polarizer section.

2. The waveguide device of claim 1, wherein the slot coupling hole is surrounded by material of the conductive septum.

3. The waveguide device of claim 1, wherein the slot coupling hole has a rectangular cross-section.

4. The waveguide device of claim 1, wherein the slot coupling hole suppresses a propagation mode of a signal within the polarizer section.

5. The waveguide device of claim 4, wherein the signal includes a first frequency band and a second frequency band, wherein the second frequency band is higher than the first frequency band, and the slot coupling hole suppresses the propagation mode at the second frequency band.

6. The waveguide device of claim 1, wherein the polarizer section further includes a first asymmetric sidewall feature on a first sidewall of the polarizer section.

7. The waveguide device of claim 6, wherein the first sidewall is of a first set of opposing sidewalls of the polarizer section, and the first asymmetric sidewall feature does not extend between a second set of opposing sidewalls of the polarizer section.

8. The waveguide device of claim 6, further comprising a second asymmetric sidewall feature on a second sidewall of the polarizer section.

9. The waveguide device of claim 8, wherein the first and second asymmetric sidewall feature are mirror images.

10. The waveguide device of claim 6, the first asymmetric sidewall feature entirely within the polarizer section.

11. The waveguide device of claim 1, further comprising a dielectric insert including a first dielectric portion partially filling the polarizer section.

12. The waveguide device of claim 11, wherein the dielectric insert includes a first retention feature, and the waveguide device includes a second retention feature corresponding to the first retention feature.

13. The waveguide device of claim 11, further comprising an antenna element coupled to the first common waveguide, wherein the dielectric insert includes at least one feature to provide transitioning with the antenna element.

14. The waveguide device of claim 1, wherein:

the second waveguide corresponds to a first polarization; and the third waveguide corresponds to a second polarization.

* * * * *